US011473243B2

(12) United States Patent
Lampinen et al.

(10) Patent No.: US 11,473,243 B2
(45) Date of Patent: Oct. 18, 2022

(54) METHOD AND A SYSTEM FOR REMOVING HYDROGEN SULPHIDE IONS ($HS^-$) FROM A LIQUOR OF A PULP MILL PROCESS

(71) Applicant: Valmet Technologies Oy, Espoo (FI)

(72) Inventors: Rami Lampinen, Tampere (FI); Erkki Välimäki; Tuomo Hilli, Tampere (FI)

(73) Assignee: VALMET TECHNOLOGIES OY, Espoo (FI)

( * ) Notice: Subject to any disclaimer, the term of this patent is extended or adjusted under 35 U.S.C. 154(b) by 237 days.

(21) Appl. No.: 16/756,781

(22) PCT Filed: Oct. 15, 2018

(86) PCT No.: PCT/FI2018/050739
§ 371 (c)(1),
(2) Date: Apr. 16, 2020

(87) PCT Pub. No.: WO2019/077202
PCT Pub. Date: Apr. 25, 2019

(65) Prior Publication Data

US 2021/0189648 A1 Jun. 24, 2021

(30) Foreign Application Priority Data

Oct. 20, 2017 (FI) ..... 20175925

(51) Int. Cl.
*D21C 11/00* (2006.01)
*D21C 11/04* (2006.01)
*F04F 5/42* (2006.01)

(52) U.S. Cl.
CPC ..... *D21C 11/0057* (2013.01); *D21C 11/04* (2013.01); *F04F 5/42* (2013.01)

(58) Field of Classification Search
CPC ..... D21C 11/0057
See application file for complete search history.

(56) References Cited

U.S. PATENT DOCUMENTS 2,000,762 A 5/1935 Kraft
3,525,666 A 8/1970 Brannland
(Continued)

FOREIGN PATENT DOCUMENTS

CA 1043516 A 12/1978
CN 1108714 A 9/1995
(Continued)

OTHER PUBLICATIONS

Leiviska (editor), Process Control, 1999, Fapet Oy, p. 92-93. (Year: 1999).*
(Continued)

*Primary Examiner* — Anthony Calandra
(74) *Attorney, Agent, or Firm* — Alston & Bird LLP

(57) ABSTRACT

A method for removing hydrogen sulphide ions ($HS^-$) from a liquor (300) of a pulp mill process, the method comprising pumping the liquor (300) to an injector arrangement (710) using a pump arrangement (720) such that the pumping of the liquor (300) through a jet nozzle (115) generates suction at a gas inlet (130), whereby reagent gas (310) is mixed with the liquor (300), and letting out the treated liquor (300) from the injector arrangement (710) to a vessel (200). In this way, the liquor (300) is treated to form at least partly treated liquor (300). A corresponding use of an injector arrangement. A system for performing the method.

20 Claims, 12 Drawing Sheets

(56) References Cited

U.S. PATENT DOCUMENTS

| | | | | | |
|---|---|---|---|---|---|
| 3,655,343 | A * | 4/1972 | Galeano | D21C 11/0057 422/111 |
| 4,053,352 | A | 10/1977 | Hultman et al. | |
| 4,058,433 | A | 11/1977 | Fuller et al. | |
| 4,253,911 | A | 3/1981 | Hillstrom et al. | |
| 5,382,322 | A | 1/1995 | Magnotta et al. | |
| 5,439,556 | A * | 8/1995 | Sethna | D21C 11/0057 162/239 |
| 6,168,685 | B1 | 1/2001 | Ho | |
| 7,241,389 | B2 | 7/2007 | Campo et al. | |
| 2002/0021994 | A1 | 2/2002 | Blue et al. | |
| 2010/0243580 | A1 | 9/2010 | Lobban | |
| 2016/0002853 | A1 | 1/2016 | McKeough | |

FOREIGN PATENT DOCUMENTS

| | | | | |
|---|---|---|---|---|
| CN | 201411590 Y * | 2/2010 | | D21C 11/04 |
| CN | 101868426 A | 10/2010 | | |
| CN | 104937166 A | 9/2015 | | |
| EP | 0643163 B1 | 12/2001 | | |
| GB | 2527096 A | 12/2015 | | |
| WO | WO-2013178885 A1 * | 12/2013 | | D21C 11/0057 |

OTHER PUBLICATIONS

Chinese Office Action for Chinese Patent Application No. 201880068195.X, dated Sep. 3, 2021, (11 pages), China National Intellectual Property Administration, Beijing, China.

International Searching Authority, International Search Report and Written Opinion for International Application No. PCT/FI2018/050739, dated Jan. 10, 2019, (14 pages), European Patent Office, Rijswijk, The Netherlands.

* cited by examiner

METHOD AND A SYSTEM FOR REMOVING HYDROGEN SULPHIDE IONS ($HS^-$) FROM A LIQUOR OF A PULP MILL PROCESS

CROSS REFERENCE TO RELATED APPLICATIONS

This application is a National Stage Application, filed under 35 U.S.C. § 371, of International Application No. PCT/FI2018/050739, filed Oct. 15, 2018, which claims priority to Finland Application No. 20175925, filed Oct. 20, 2017; the contents of both of which are hereby incorporated by reference in their entirety.

BACKGROUND

Related Field

The invention relates to a method and a system for removing hydrogen sulphide ions ($HS^-$) from some liquor of a liquor circulation of a pulp mill process. The invention relates to a method and a system for oxidizing white liquor of a pulp mill process. The invention relates to a method and a system for oxidizing and acidifying black liquor of a pulp mill process. The invention relates to a method and a system for acidifying black liquor of a pulp mill process. The invention relates to a method and a system for acidifying green liquor of a pulp mill process. The hydrogen sulphide ions ($HS^-$) are removed using a gas mixed with the liquor with an injector arrangement. The invention relates to a use of an injector arrangement for removing hydrogen sulphide ions ($HS^-$) from a liquor of a pulp mill process.

DESCRIPTION OF RELATED ART

Liquors, such as white liquor, black liquor, or green liquor, of a primary liquor circulation of a pulp mill process comprise hydrogen sulphide ions ($HS^-$). These liquors are utilized in various processes. As an example, white liquor may be used in a process for delignification pulp or in a process for bleaching pulp. Such a process requires oxygen for delignification or bleaching. However, when the liquor comprises compounds that are not fully oxidized, such as sodium sulphide $Na_2S$ in the form of ions including hydrogen sulphide $HS^-$, some of the oxygen of delignification and/or bleaching process is consumed to the oxidation of the liquor, which deteriorates the process of delignification and/or bleaching. Therefore, it is known to oxidize the liquor of a liquor circulation of a pulp mill process before utilization in order to reduce the need of make-up chemical e.g. NaOH consumption in delignification and bleaching process.

FIGS. 1*a* and 1*b* show a process for oxidizing white liquor, as known from the patent EP0643163. Referring to FIG. 1*a*, in the known art, white liquor 902 is sprayed into a vessel 910 with nozzles 904. Thus, in use, the vessel 910 is at least partly filled with white liquor. In addition, air 912 is compressed with an air compressor 920 to air nozzles 914 arranged in the bottom of the vessel 910. Referring to FIG. 1*b*, in order to have the air uniformly spread to the vessel, the bottom of the vessel 910 is equipped with multiple air nozzles 914 arranged all over the bottom of the vessel. The air forms air bubbles to the white liquor. The white liquor reacts with the oxygen of the air at the interfaces between the air bubbles and the white liquor, in this way oxidizing the sodium sulphide $Na_2S$ of the white liquor in the vessel 910.

The prior art has some problems. The compressor 920 requires a lot of energy, as some of the work of the compressor is stored as internal energy of the compressed air. Moreover, compressors are typically noisy. In addition, the air nozzles 914 clog frequently, at least if the nozzles are small. Thus, to prevent clogging, the orifices of the air nozzles are typically reasonably large, e.g. in the range from 6 mm to 8 mm in diameter. Such nozzles, however, produce reasonably large air bubbles. A typical size (i.e. diameter) of the air bubbles in the prior art solution is in the range of tens of millimetres. Large air bubbles have the property that their area is small compared to their volume. Thus, the reaction area for oxidization remains small. This results in long reactions times, typically in the order of from 10 hours to 20 hours. Moreover, even if large orifices are used, the nozzles clog from time to time. This increases the maintenance needs.

Another problem in the prior art is related to the process temperature. The oxidation reaction is exothermic, whereby the temperature within the vessel 910 tends to rise. Moreover, because the air 912 is compressed in the compressor 920, it also becomes heated. Typically the air pressure is so high that its temperature increases to about 110° C.-120° C. This, on one hand makes the compressor 920 itself an expensive component and on the other hand tends to heat the white liquor in the vessel 910 excessively.

Furthermore, the high temperature of the air increases the risk of clogging of the air nozzles 914, since the hot air may heat the white liquor locally at the air nozzles 914, and the precipitating solids will clog the air nozzles 914. Examples of solids causing clogging include solids comprising calcium, such as calcium oxide (CaO), calcium carbonate ($CaCO_3$), and pirssonite $Na_2Ca(CO_3).2H_2O$.

BRIEF SUMMARY

It has been found that the risk of clogging the air nozzles, when treating a liquor of a pulp mill process by a reagent gas in order to remove hydrogen sulphide ions from the liquor, can be minimized by using, instead of conventional air nozzles, an injector or an injector arrangement comprising at least one injector. The injector is configured to let reagent gas in by suction generated by the flow of liquor through a jet nozzle or jet nozzles. In addition, it has been found that an injector generates much smaller bubbles of reagent gas, compared to prior art, whereby the ratio of the area of the bubbles to their volume is much higher. As a result, the reaction area for the oxidation reaction or acidifying of the liquor increases, whereby the time needed for oxidation or acidification becomes smaller. When time can be reduced, smaller vessels suffice. This provides for investment savings and enable to design the layout of the mill more freely. The reagent gas is configured to remove hydrogen sulphide ions from the liquor by reaction with the liquor. The reagent gas may comprise oxygen to oxidize the liquor. The reagent gas may comprise some acid gas, such as carbon dioxide or sulphur dioxide, to acidify the liquor.

As indicated above, hydrogen sulphide ions $HS^-$ may be removed from white liquor by oxidation.

As another example of removing hydrogen sulphide ions $HS^-$ from a liquor, black liquor, optionally pre-treated, may comprise sodium sulphide $Na_2S$ in form of ions including bisulphide $HS^-$. Moreover, in a non-alkaline liquor, the hydrogen sulphide ions tend to form dihydrogen sulphide $H_2S$, which is a poisonous and odorous gas. In order to diminish $H_2S$ emissions, the hydrogen sulphide ions $HS^-$ may be oxidized in a similar manner as discussed above, by reaction with gas containing oxygen.

As a further example of removing hydrogen sulphide ions $HS^-$ from a liquor, green liquor comprises sodium sulphide $Na_2S$ in form of ions including $HS^-$ and $Na^+$, and optionally also $S^{2-}$. The sulphidity of green liquor, i.e. the molar ratio of sodium sulphide to the sum of sodium hydroxide and sodium sulphide, affects the chemical circulation of the pulp mill. For example, the sulphidity may have an effect on forming solid compounds containing sodium. Therefore, there may be a need to adjust the sulphidity. Sulphidity can be affected e.g. by acidifying the green liquor, whereby the hydrogen sulphide ions $HS^-$ form dihydrogen sulphide $H_2S$ in gaseous form. Acidifying can be done e.g. by reacting the green liquor with suitable reagent gas, such as an acid gas.

The invention is more specifically detailed in independent claims 1, 13, and 14. Preferable embodiments are disclosed in the dependent claims. The description and the drawings disclose also other embodiments.

Figure 1A:
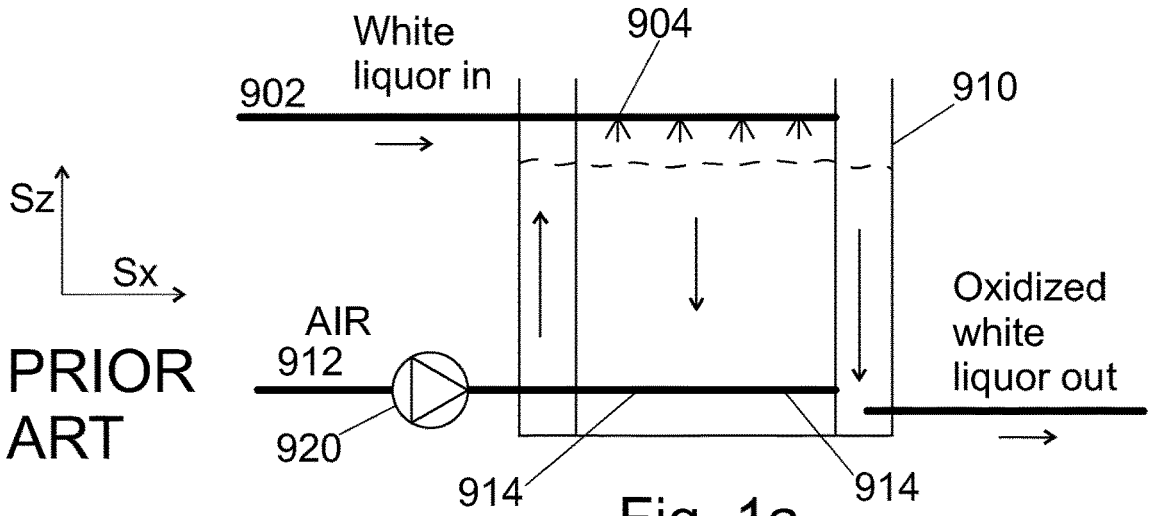
FIG. 1*a* shows, in a side view, a system for oxidizing white liquor as known in prior art.

In the drawings, three orthogonal directions are indicated by Sx, Sy, and Sz. In use, Sz may be e.g. upward vertical direction.

DETAILED DESCRIPTION OF VARIOUS EMBODIMENTS

Figure 2A:
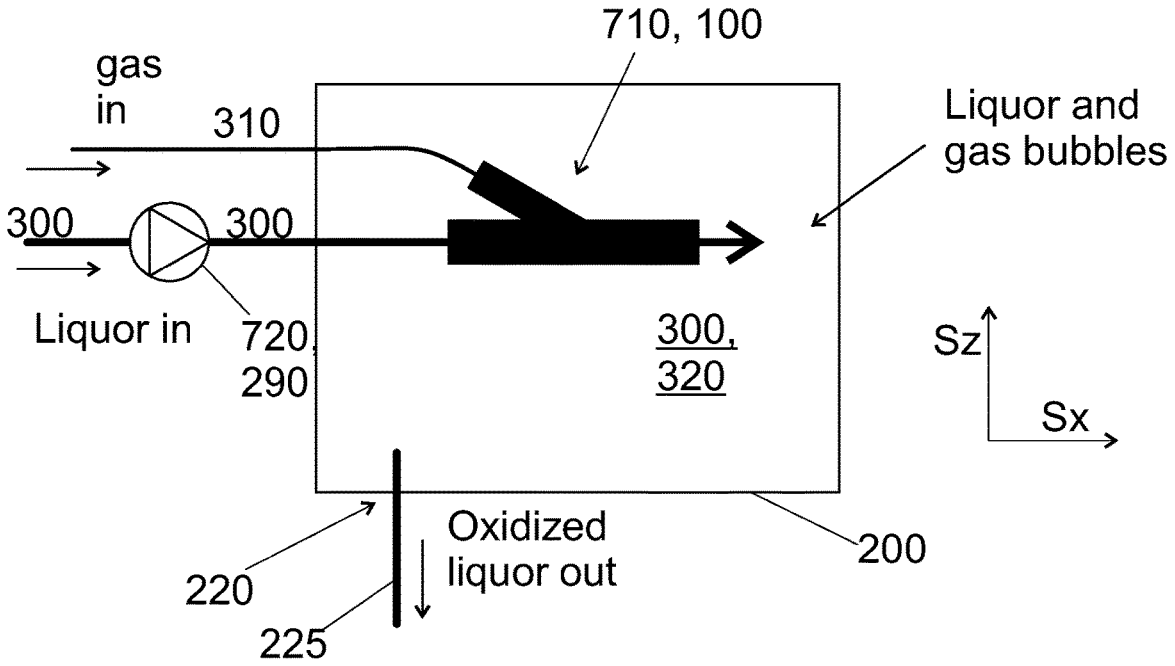
FIG. 2*a* shows, in a principal side view, a system for removing hydrogen sulphide ions ($HS^-$) from liquor of a pulp mill process, the system comprising an injector.
Figure 2B:
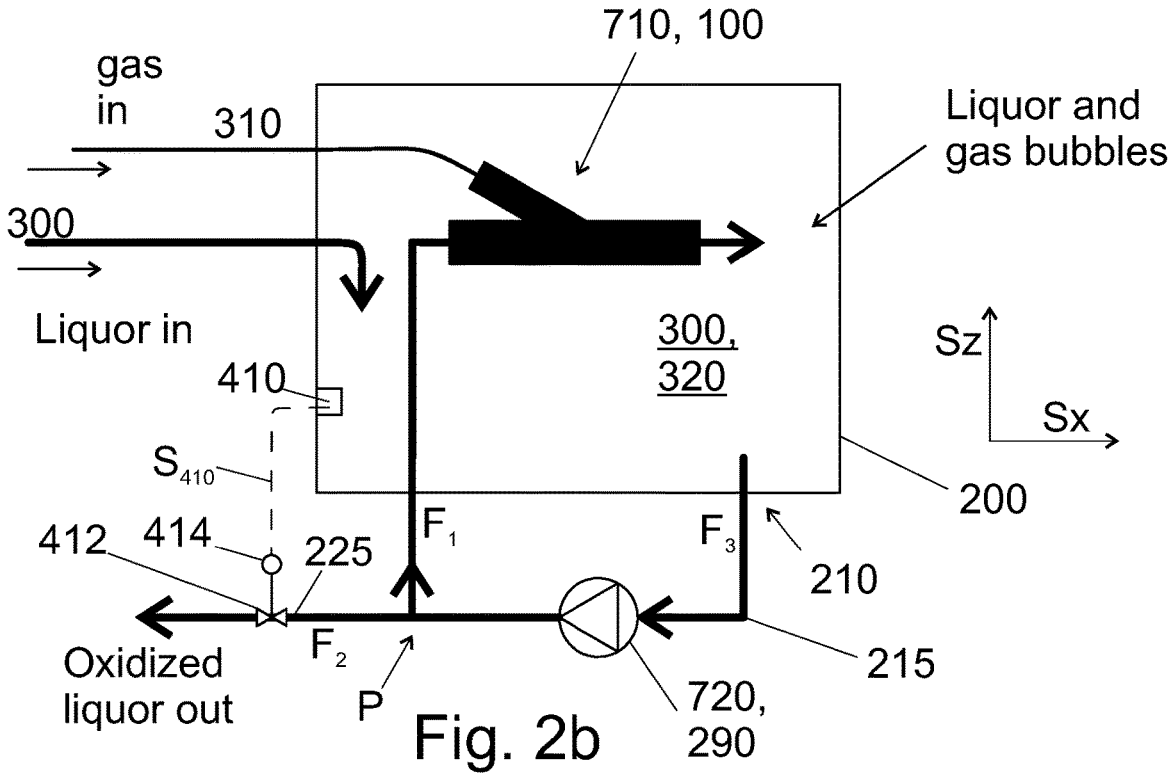
FIG. 2*b* shows, in a principal side view, another system for removing hydrogen sulphide ions ($HS^-$) from a liquor of a pulp mill process, the system comprising an injector and means for recycling the liquor that is oxidized.
Figure 2C:
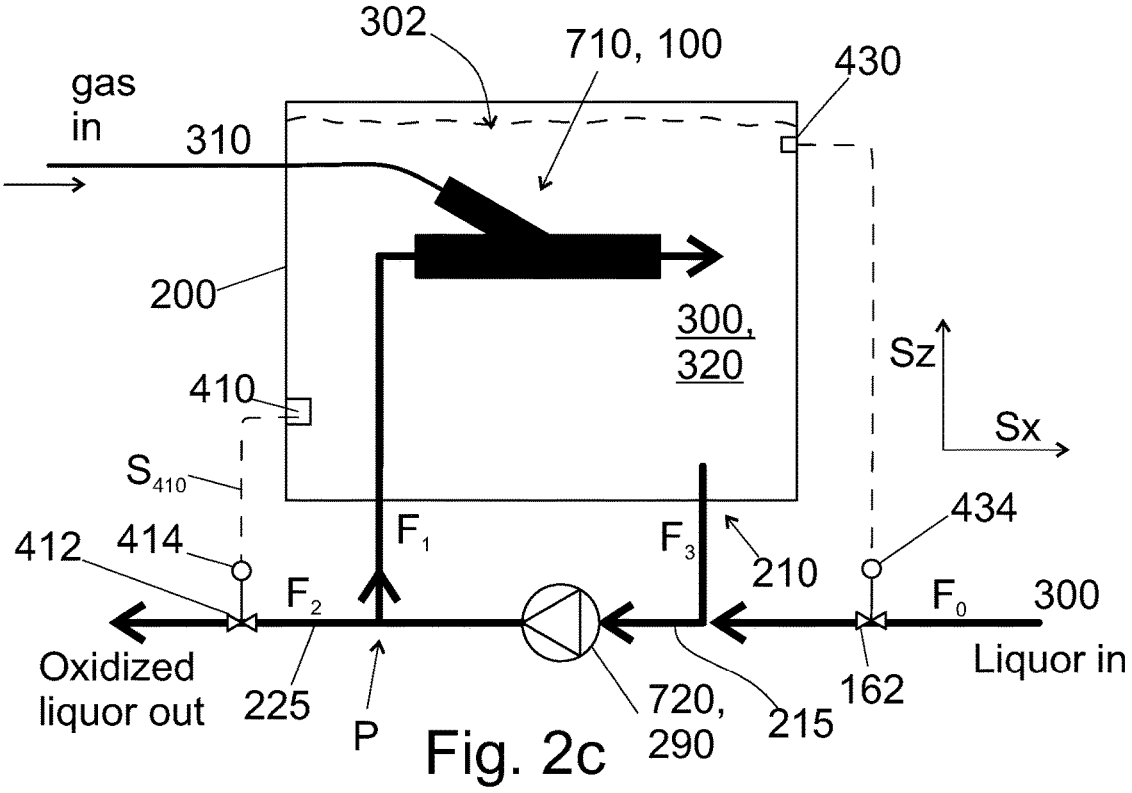
FIG. 2*c* shows, in a principal side view, another system for removing hydrogen sulphide ions ($HS^-$) from liquor of a pulp mill process, the system comprising an injector and means for recycling the liquor that is oxidized.

The embodiments will be discussed with reference to Figures. E.g. FIGS. 2*a*, 2*b*, and 2*c* show a part of a system for removing hydrogen sulphide ions ($HS^-$) from some liquor 300 of a liquor circulation of a pulp mill process. Correspondingly e.g. FIGS. 2*a*, 2*b*, and 2*c* show a method for removing hydrogen sulphide ions ($HS^-$) from some liquor 300 of a liquor circulation of a pulp mill process. Commonly hydrogen sulphide ions $HS^-$ are called bisulfide. The system and process will be described primarily such that the $HS^-$ ions are removed by oxidation, the oxidation thus being an example of a method for removing bisulphide (i.e. hydrogen sulphide ions). As detailed later, acidifying is another method for removing bisulphide. In addition, when both oxidation and acidifying are used, these can be applied simultaneously or subsequently. In the embodiments, the liquor 300 is treated by mixing reagent gas 310 with the liquor, thereby removing hydrogen sulphide ions. In connection with the method, the flow of the liquor 300 from one location to another will be discussed, and the liquor 300 is conveyed (e.g. by pumping or by a pressure difference) in a corresponding manner. Even if not explicitly always mentioned, a corresponding system comprises pipelines suitable for such purposes and configured to such purposes.

FIG. 2*a* shows a part of a system for oxidizing some liquor 300 of a liquor circulation of a pulp mill process. Correspondingly, FIG. 2*a* describes a method for removing bisulphide from some liquor 300 of a primary liquor circulation of a pulp mill process. A pulp mill process refers to a process carried out in a pulp mill, in particular a process for producing pulp, such as the Kraft process. The primary liquor circulation refers in particular to a circulation of the liquor comprising the cooking chemicals of the Kraft process. Such a liquor typically comprises at least aqueous sodium sulphide $Na_2S$. At least a part of the sodium sulphide is, in an aqueous solution, in the form of ions including $HS^-$ and $Na^+$, and optionally also $S^{2-}$. In particular, the bisulphide $HS^-$ and optionally also nucleophilic sulphide $S^{2-}$ take part in the digestion of wood chips in the Kraft process. Examples of such liquor include black liquor, green liquor, and white liquor. Typically, the liquor 300 of the primary circulation of the pulp mill is alkaline. In an embodiment, the liquor 300 that is treated to remove bisulphide has a pH of at least 8, such as at least 9. An embodiment of the method comprises receiving liquor 300 comprising sulphur, optionally bound to a chemical compound. An embodiment of the method comprises receiving liquor 300 having a pH of at least 8, such as at least 9 and comprising sulphur, optionally bound to a chemical compound.

Black liquor is a waste product from a Kraft process when digesting pulpwood. Weak black liquor is an aqueous solution of lignin residues, hemicellulose, and the inorganic chemicals used in the Kraft process. Weak black liquor may be dried an burned in a chemical recovery boiler, which produces smelt from the black liquor. Green liquor is produced in such a chemical recovery boiler, in which the black liquor is burnt, and the resulting smelt is dissolved to weak white liquor to produce green liquor. Calcium oxide (CaO) is added to the green liquor in a slaker, and the liquor is agitated in a cauticizer, which in this way produces white liquor. Both the green liquor and the white liquor comprise sodium sulphide ($Na_2S$), which can be oxidized to sodium sulphate ($Na_2SO_4$) and/or sodium thiosulphate ($Na_2S_2O_3$); the compounds being in the form of ions in an aqueous solution. Typically, sodium sulphide is first oxidized to sodium thiosulphate and thereafter the sodium thiosulphate is oxidized to sodium sulphate. However, during oxidation of NaS, all these compounds may be present to various amounts depending on the degree of oxidation. Also green liquor comprises sodium sulphide. However, as motivated in the background, hydrogen sulphide ions of green liquor are typically removed by acidifying. Acidifying can be done by using an acid gas, such as carbon dioxide ($CO_2$), sulphur dioxide ($SO_2$), sulphur trioxide ($SO_3$), a nitrogen oxide (NOx), a hydrogen halide, or formic acid (HCOOH). The term hydrogen halide refers to a chemical compound containing hydrogen and a halogen, e.g. a compound of the group consisting of: hydrogen fluoride (HF), hydrogen chloride (HCl), hydrogen bromide (HBr), hydrogen iodide (HI). Preferable gases for acidification include carbon dioxide ($CO_2$) and sulphur dioxide ($SO_2$), in particular carbon dioxide ($CO_2$).

In addition to chemical recovery, weak black liquor may be used as a raw material for lignin. Thus black liquor may be dried to some extent and acidified to precipitate lignin. The black liquor may be oxidized to remove hydrogen sulphide ions. Green liquor may be acidified to control the sulphidity, as indicated above.

Referring to FIGS. 2*a*, 2*b*, and 2*c*, in the method and system, an injector arrangement 710, i.e. a first injector arrangement 710, is used to suck reagent gas 310, i.e. first reagent gas 310, to be mixed with the liquor 300. The reagent gas 310 is configured to remove hydrogen sulphide ions $HS^-$ from the liquor 300 by reaction with the liquor 300. The reagent gas 310 may comprise oxygen to oxidize the liquor 300. The reagent gas 310 may comprise an acid gas, examples of which were given above, to acidify the liquor 300. The reagent gas 310 may comprise both oxygen and an acid gas. Preferably the acid gas, if used, comprises carbon dioxide ($CO_2$) and/or sulphur dioxide ($SO_2$).

When the injector arrangement 710 is used for oxidation, the reagent gas 310 comprises at least oxygen ($O_2$). In an embodiment, the reagent gas 310 comprises at least 15 vol % oxygen. Preferably, the reagent gas 310 comprises at least oxygen ($O_2$) and nitrogen ($N_2$), e.g. the reagent gas 310 is air. However, pure oxygen or oxygen mixed with air can be used as the reagent gas 310. Moreover, a mixture of steam and air can be used as the reagent gas 310, for example if the liquor 300 and/or the reagent gas 310 needs to be heated. This may have the effect that the oxygen content of the reagent gas 310 is less than that of air. In an embodiment, the reagent gas 310 comprises at least oxygen and nitrogen such that the reagent gas 310 comprises at least 15 vol % oxygen. In an embodiment, the reagent gas 310 comprises at least oxygen and nitrogen such that the reagent gas 310 comprises at least 20 vol % oxygen.

When the injector arrangement 710 is used for acidifying, the reagent gas 310 comprises at least an acid gas, examples of which were given above, for example carbon dioxide ($CO_2$) or sulphur dioxide ($SO_2$). In an embodiment, the reagent gas 310 comprises at least 1 vol % of acid gases or an acid gas. In an embodiment, the reagent gas 310 comprises at least 10 vol % acid gases or an acid gas. In an embodiment, the reagent gas 310 comprises at least 50 vol % acid gases or an acid gas.

Referring still to FIG. 2*a*, the injector arrangement 710 comprises at least one injector 100. The injector arrangement 710 may comprise several injectors 100*a*, 100*b*, 100*c* as indicated e.g. in FIGS. 6*b* and 6*d*. When using the injector arrangement 710, the liquor 300 (or partly treated liquor, i.e. recycled liquor) is pumped with a pump arrangement 720, i.e. a first pump arrangement 720, into the injector arrangement 710 to create such a flow of the liquor 300 that the injector(s) 100 of the injector arrangement 710 function(s) as designed. Herein, the partly treated liquor 300 refers to the liquor that has been treated (i.e. oxidized and/or acidified) to some extent. The pump arrangement 720 comprises at least one pump 290. Injectors are sometimes referred to as ejectors.

Injectors as such have been known for a long time, e.g. from U.S. Pat. No. 2,000,762 ("Fluid jet pump" by H. Kraft, patented May 7, 1935). The operating principles of an injector are described therein. Thus the details and principles of the injector 100 are only briefly discussed. The embodiments relate to use of an injector arrangement 710 for oxidizing or acidification some liquor 300 of a liquor circulation of a pulp mill process; and a corresponding system. In other words, the embodiments relate to use of an injector arrangement 710 for removing hydrogen sulphide ions ($HS^-$) from a liquor 300 of a pulp mill process; and a corresponding system.

As indicated in the prior art, suction of the reagent 310 gas may be generated on one hand by the increase of the flow velocity of the liquor 300 at a jet nozzle 115, and on the other hand by movement of injected liquor 300 (i.e. a jet 116), which pushes some of the reagent gas 310 towards an outlet 140 of the injector 100. For structural details of an injector, see FIGS. 3, 4*a*, and 4*b*.

Referring to FIG. 2*b*, the liquor 300 may be treated (e.g. oxidized) by recycling it through the injector arrangement 710 using the pump arrangement 720. Correspondingly, the liquor 300 to be treated (e.g. to be oxidized; the liquor to be treated being un-treated or partly treated liquor 300) is conveyed to a vessel 200. Treatment is achieved by pumping the liquor 300, which may be partly or fully treated, from the vessel 200, through the injector arrangement 710, back to the vessel 200. Thus, recycling of the liquor 300 produces a circulation, i.e. secondary circulation, of the liquor 300.

Referring to FIG. 2*c*, the liquor 300 to be treated (e.g. oxidized) may conveyed into the vessel through the pump arrangement 720 also when the liquor 300 is recycled from the vessel 200, through the injector arrangement 710, back to the vessel 200.

Figure 3:
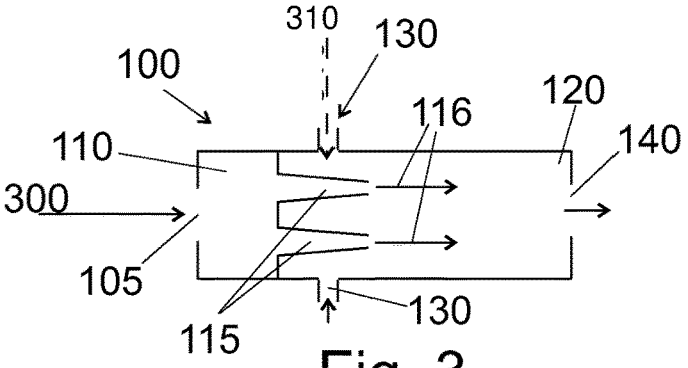
FIG. 3 shows, in a principal side view, an injector.
Figure 4A:
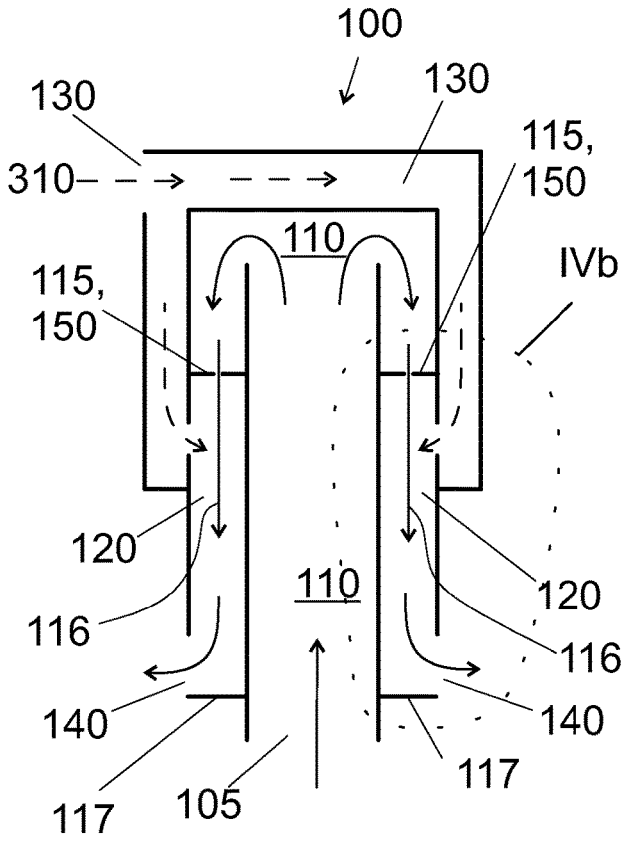
FIG. 4*a* shows, in a principal side view, an injector.

FIGS. 3 and 4*a* show in detail an injector 100. Referring to FIGS. 3 and 4*a*, an injector 100 comprises

- an inlet 105 for receiving the liquor 300 from the pump arrangement 720 (cf. FIG. 2*a*),
- a first chamber 110 configured to receive the liquor 300 from the inlet 105 for the liquor 300,
- a second chamber 120 arranged, in the direction in flow of the liquor 300, downstream from the first chamber 110, at least a jet nozzle 115 arranged, in the direction in flow of the liquor 300, in between the first chamber 110 and the second chamber 120, a gas inlet passage 130 configured to convey air into the second chamber 120 by suction generated by the flow of the liquor 300 through the jet nozzle 115, and an outlet 140 arranged at the second chamber for expelling the liquor 300 and the gas from the second chamber 120.

The jet nozzle 115 is configured to generate a jet 116 of the liquor 300, whereby the jet 116 transfers some of the reagent gas 310 to an outlet 140 of the injector 100.

Figure 4B:
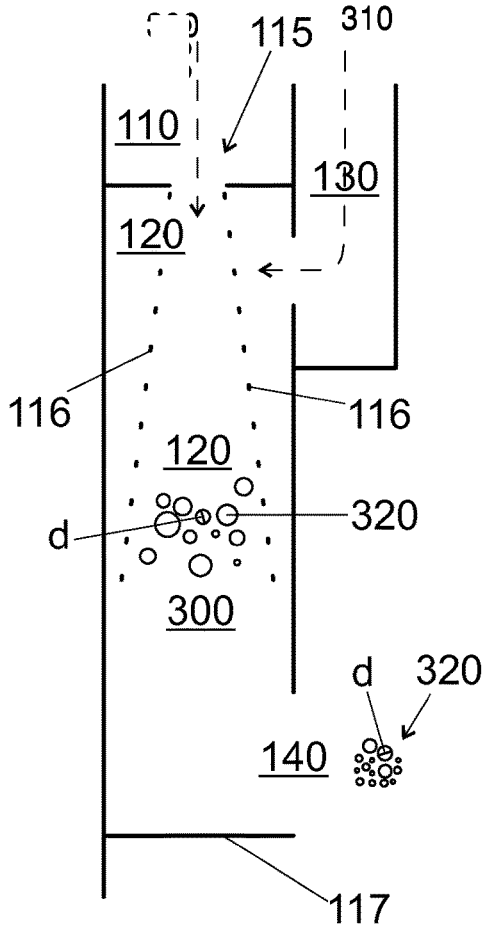
FIG. 4*b* shows an enlargement of the part IVb of FIG. 4*a*.
Figure 4C:
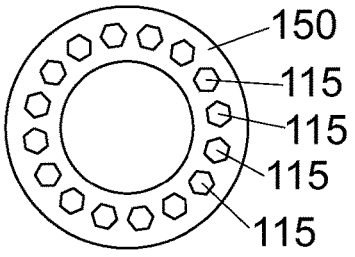
FIG. 4*c* shows a flange of the injector of FIG. 4*a*, the flange limiting multiple jet nozzles.
Figure 4D:
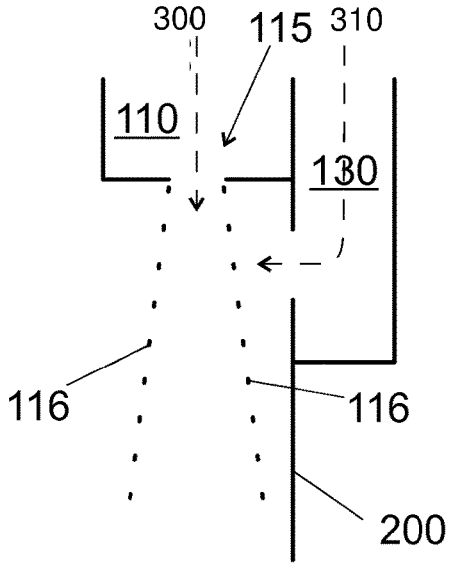
FIG. 4*d* shows, in a principal side view, an injector integrated with a vessel.

Referring to FIG. 4*d*, it may be possible to form a combination of a vessel 200 and an injector 100 such that a part of the vessel serves as the second chamber 120. Correspondingly, a separate second chamber 120 is not necessary. In such a case, the second chamber 120 of the injector forms a part of the interior of the vessel 200. Moreover a wall of the vessel 200 serves as a wall of the second chamber. In such a case, the jet 116 of the liquor 300 and the gas 310 would be formed directly into the vessel 200 as shown in FIG. 4*d*.

Referring to FIG. 4*a*, in an embodiment, a part of the second chamber 120 laterally surrounds a part of the first chamber 110. Referring to FIG. 4*a*, in an embodiment, the second chamber 120 laterally surrounds a part of the first chamber 110.

When the liquor 300 is pumped through the jet nozzle 115, the flow of the liquor 300 generates suction in such a way that reagent gas 310, such as air, will be sucked into the second chamber 120 through the inlet passage 130. In the second chamber 120 the liquor 300 becomes mixed with the reagent gas 310 whereby the liquor 300 will be treated (e.g. oxidized and/or acidified). Referring to FIG. 4*b*, the reagent gas 310 will form bubbles 320 of reagent gas 310 into the mixture of liquor 300 and gas 310. A size of the bubbles 320 is denoted by d in FIG. 4*b*.

Since the reagent gas 310 is sucked into the injector arrangement 710, the reagent gas 310 needs not to be pressurized. However, it may be pressurized. The absolute pressure of the reagent gas 310 in the inlet passage 130 of the injector 100 may be e.g. from 0.1 atm to 1 atm.

It has been found that the size d of the gas bubbles 320 produced by the injector 100 is reasonably small, whereby a high contact area between the reagent gas 310 and the liquor 300 is achieved. This improves oxidization of the liquor 300. Factors affecting the bubble size d will be discussed below.

As indicated above, a method for removing bisulphide $HS^-$ from some liquor 300 of a primary liquor circulation of a pulp mill process (e.g. by oxidizing and/or acidifying) comprises pumping the liquor 300 to an injector arrangement 710 using a pump arrangement 720, the injector arrangement 710 comprising at least one injector 100. The liquor 300 that is pumped may be un-treated or at least partly treated. The liquor 300 is pumped such that the pumping of the liquor 300 through the jet nozzle 115 generates suction at the gas inlet 130 of the injector 100, whereby reagent gas 310 is conveyed into the second chamber 120 (or vessel 200) and mixed with the liquor 300 to generate bubbles 320 of the reagent gas 310 into the liquor 300. In this way, the liquor 300 is treated by chemical and/or physical reactions occurring at the interfaces of the bubbles 320 and the liquor 300. An example of a chemical reaction oxidation. An example of a physical reaction is dissolving an acid gas to the liquor 300.

Figure 7A:
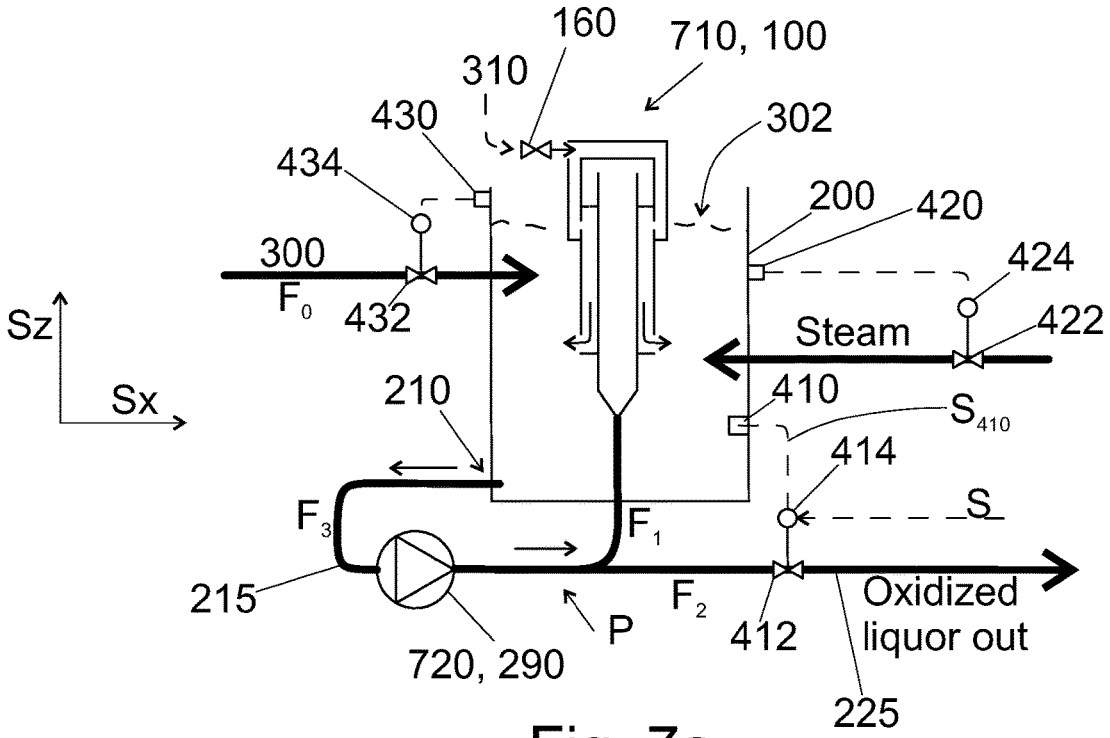
FIG. 7*a* shows a one-stage process and system for oxidizing liquor.

However, the treatment of the liquor 300 continues as long as the bubbles 320 of the reagent gas 310 remain in the liquor 300. Therefore, the method further comprises letting out the treated liquor 300 from the injector arrangement 710 to a vessel 200, i.e. a first vessel 200. The liquor 300 and the bubbles 320 may exit from an outlet 140 to the vessel 200. The bubbles 320 are present also in the vessel 200, as indicated in FIG. 4*b*. Thus, the treatment continues in the vessel 200. Moreover, from the vessel 200 the treated liquor 300 can be conveyed to a point of use. Referring to FIGS. 2*b* and 7*a*, the treated liquor 300 can be conveyed from the vessel 200 to a point of use through the pump arrangement 720 that is used for pumping some of the treated liquor 300 back to the vessel 200 through the injector arrangement 710.

As indicated in the background, a point of use for the treated liquor may be e.g. a process for delignification or a process for bleaching pulp, in particular, when the liquor 300 is white liquor of a pulp mill process. In an embodiment, the liquor 300 is white liquor of a Kraft process of a pulp mill. An embodiment comprises forming the liquor 300 of the pulp mill process in a causticizer, whereby the liquor 300 is white liquor. In an embodiment, the liquor 300 is white liquor and the reagent gas 310 comprises oxygen. What has been said above about the oxygen content of the reagent gas, applies in the embodiment. An embodiment comprises using the oxidized white liquor 300 in oxygen delignification and bleaching process for pulp.

Referring to FIGS. 4*a*, 4*b*, and 4*c*, the jet nozzle 115 may be formed as an aperture 115 in a flange 150, wherein the flange 150 is arranged in between the first chamber 110 and the second chamber 120. Referring to FIG. 4*c*, a flange 150 in between the first chamber 110 and the second chamber 120 may comprise multiple apertures 115 serving as jet nozzles. Referring to FIG. 4*b*, when the liquid 300 flows through the jet nozzle 115, the liquid 300 forms a jet 116 (indicated with dotted lines). The jet 116 transfers the reagent gas 310 with itself and within the second chamber 120 as discussed above. In this way, bubbles 320 are formed. However, referring to FIG. 4*a*, preferably the injector 100 further comprises a collision element 117 such that the jet 116 is directed towards the collision element 117. When the jet 116 with the reagent gas 310 collides with the collision element 117, the bubbles 320 become divided into smaller bubbles 320, whereby the diameter d of the bubbles 320 decreases. This is schematically shown in FIG. 4*b* by showing the bubbles 320 in two different locations. This has a beneficial effect on the treatment (oxidation and or acidifying), as indicated above. In an embodiment, the system comprises a collision element 117 that is configured to divide the bubbles 320 of the jet 116 by collision of the jet 116 with the collision element 117. In an embodiment, the system comprises a collision element 117, and the jet nozzle 115 is arranged relative to the collision element 117 so that a jet 116 formed by the jet nozzle 115 is directed towards the collision element 117. Moreover, the jet 116 is configured to collide with the collision element 117. The collision element 117 may be arranged in the second chamber 120, the collision element 117 may form a part of a wall of the second chamber 120, or the collision element 117 may be arranged in the vessel 200 in case the injector is integrated with the vessel. The system of FIG. 4*d* could be equipped with such a collision element 117. In an embodiment, the injector 100 comprises the collision element 117 (see FIGS. 4*a* and 4*b*).

Figure 5A:
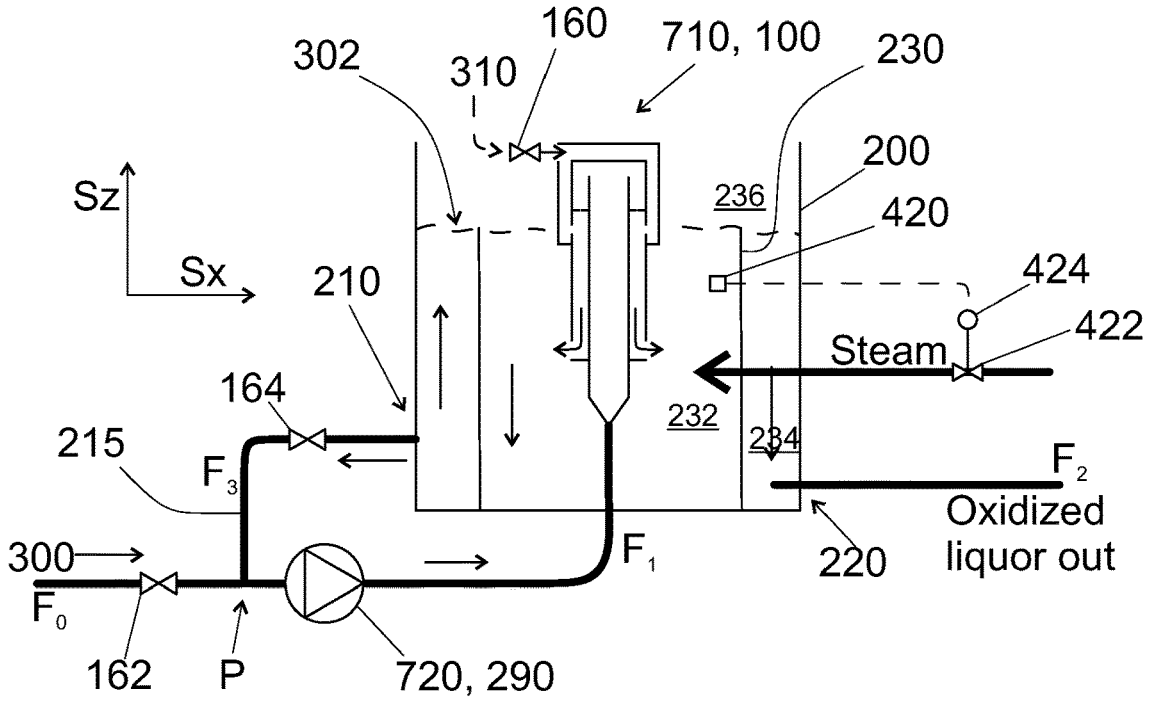
FIGS. 5*a* and 5*b* show, in a principal side view, systems for removing hydrogen sulphide ions ($HS^-$) from a liquor of a pulp mill process, the systems comprising an injector and being retrofitted to a system of FIG. 1*a*.
Figure 5B:
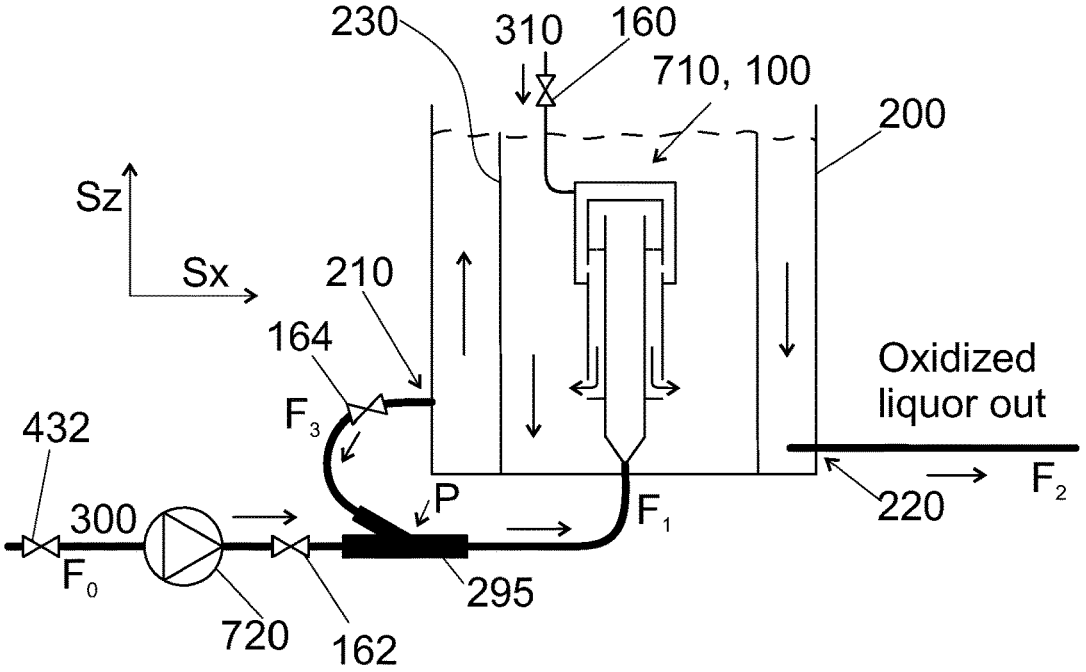
Figure 6A:
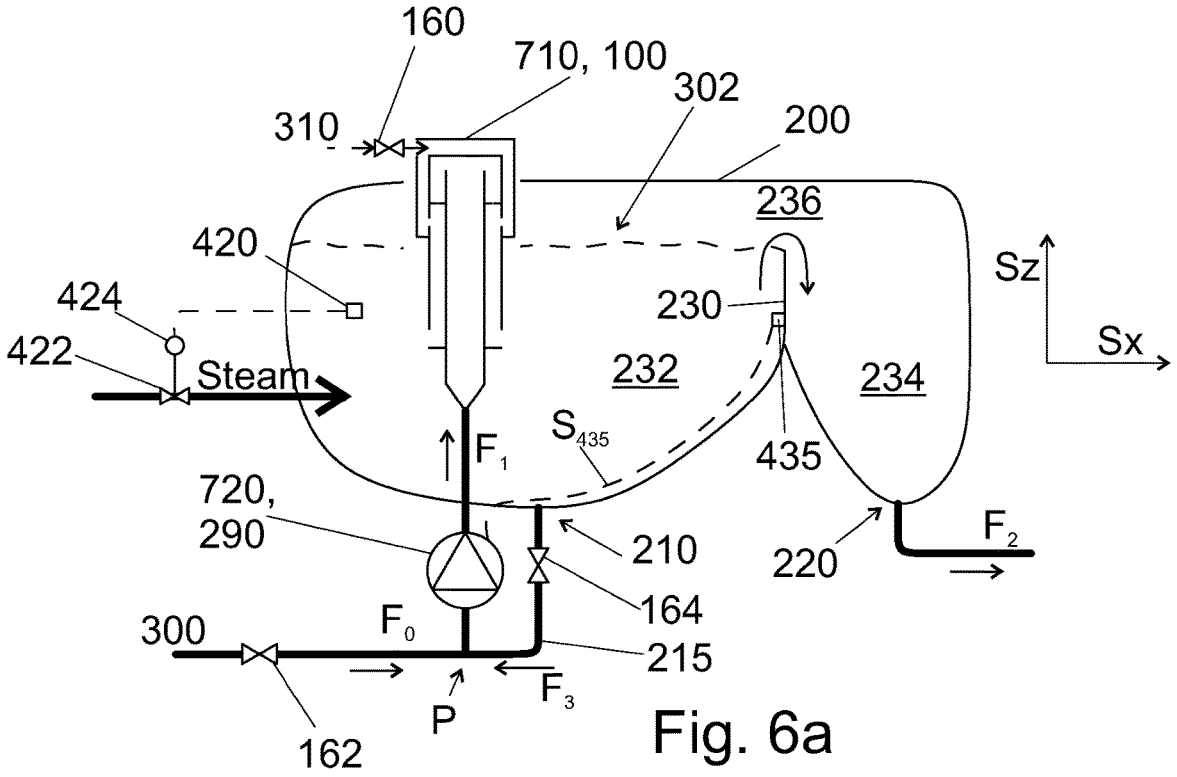
FIG. 6*a* shows, in a principal side view, a system for removing hydrogen sulphide ions ($HS^-$) from a liquor of a pulp mill process, the system comprising an injector arrangement with three injectors.

An embodiment comprises controlling the amount of reagent 310 gas that is conveyed into the second chamber 120. The amount of reagent 310 gas may be controlled e.g. by using a valve 160, as indicated in FIGS. 5*a*, 5*b*, and 6*a*.

However, typically the flow of reagent gas needs not to be limited. Rather, as much reagent gas 310 is mixed with the liquor 300 as possible. Thus, a valve 160 for limiting the flow of reagent gas is not necessary.

Referring to FIGS. 2*b*, 5*a*, 5*b*, 6*a*, 6*b*, 6*c*, 6*d*, 7*a*, 7*b*, 7*c*, 8, 9, and 10, an embodiment comprises conveying a part of the liquor 300 from a first outlet 210 of the vessel 200 to a secondary circulation of the liquor 300 to a point P that is upstream from the injector arrangement 710 in a direction of flow of the liquor 300. This has the effect, that the partly treated liquor 300 in the vessel 200 is further treated by recycling some of the liquor back to the injector arrangement 710. In this way, the level of treatment (e.g. oxidation and/or acidification) of the liquor can be increased.

Referring to 7*a*, 7*b*, 7*c*, 8, and 10, in some embodiments, the point P is also downstream from a chemical recovery boiler in a direction of flow of the liquor 300. Moreover, preferably, the liquor 300 comprises at least some chemicals that have been recovered in the chemical recovery boiler, for example NaS. In these embodiment, the liquor 300 may be e.g. white liquor or green liquor.

Referring to 7*a*, 7*b*, 7*c*, and 8, in some embodiments, the point P is also downstream from a causticizer in direction of flow of the liquor 300 in the primary circulation. In these embodiment, the liquor 300 may be e.g. white liquor.

Figure 9:
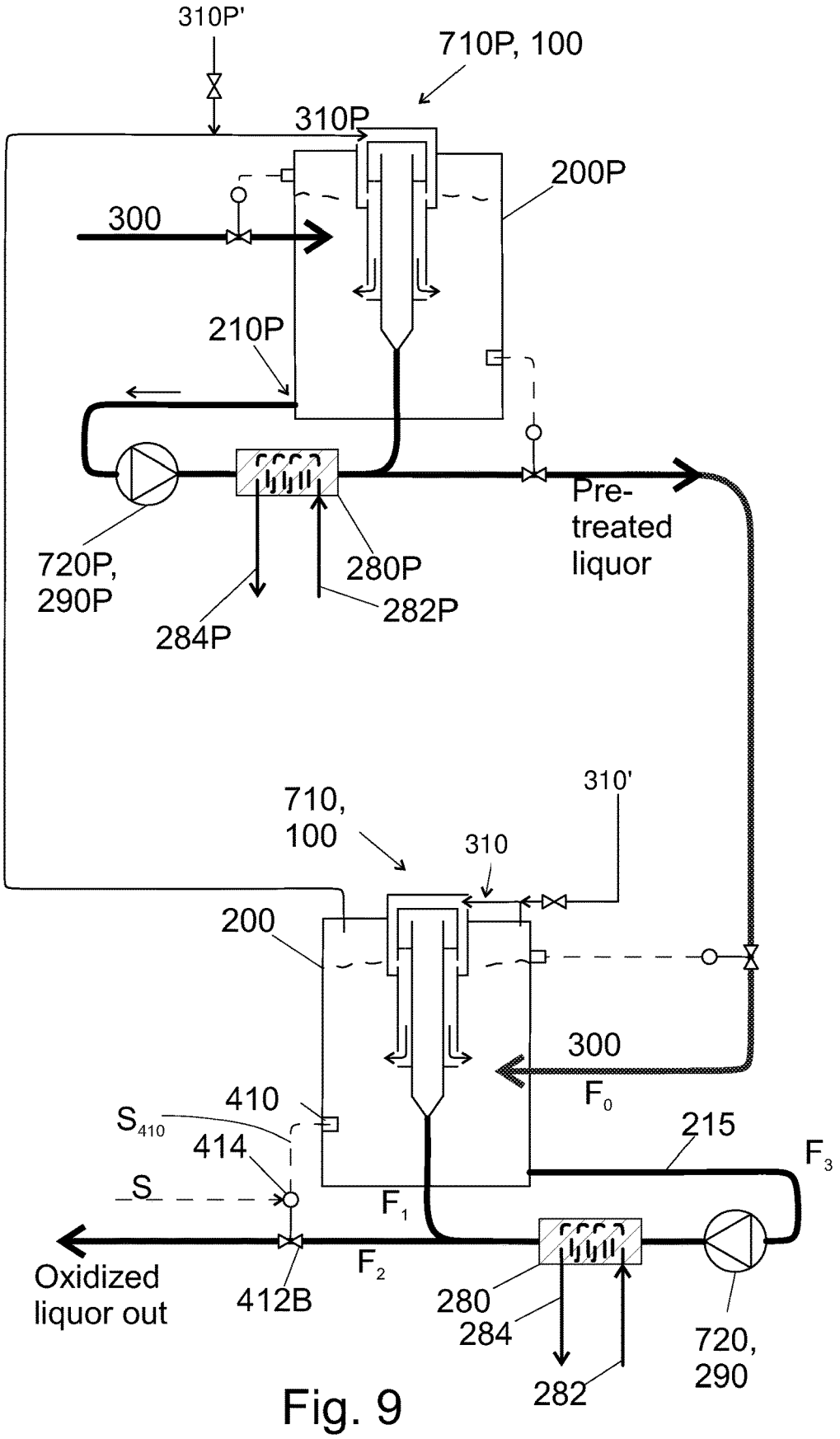
FIG. 9 shows a two-stage process and system for oxidizing and acidifying liquor and recycling of reagent gas.

However, referring to FIG. 9, black liquor can be oxidized and acidified. Alternatively and with reference to FIG. 10, black liquor can be acidified. Black liquor is taken from the primary liquor circulation of the pulp mill from a point upstream from a chemical recovery boiler and downstream from a digester.

In an embodiment, the first outlet 210 of the vessel 200 is arranged at a lower part of the vessel 200, e.g. at a bottom of the vessel 200. In the lower part of the vessel 200 the liquor 300 is typically substantially free from bubbles 320 of the reagent gas 310. Thus, having the first outlet 210 at a lower part of the vessel 200 improves controlling the amount of recycled liquor 300.

Referring to FIGS. 5*a*, 5*b*, 6*a*, 6*b*, 6*c*, 6*d*, 7*a*, 7*b*, 7*c*, 8, 9, and 10 the flow of liquor 300 to be treated is denoted by $F_0$, e.g. in the units of kg/h. The flow of the recycled liquor 300 is denoted by $F_3$, and a flow $F_1$ is fed to the injector arrangement 710. Finally, a flow of the at least partly treated liquor 300, denoted by $F_2$, $F_{2B}$ or $F_{2C}$, is let out for use. The flow may be taken directly from the vessel 200 (see FIGS. 5*a* and 5*b*) or it may be taken from a secondary liquor circulation (see FIGS. 7*a* to 7*c*). The flow $F_2$ (or $F_{2B}$ or $F_{2C}$) may be substantially the same as $F_0$. However, the treatment of the liquor 300 may increase its mass flow a little, and evaporation of the liquor 300 may decrease the mass flow a little. Typically the ratio $F_2/F_0$ is from 0.9 to 1.1 at least at some point of time.

Referring to FIGS. 5*a*, 6*a*, 6*b*, 6*c*, 6*d*, 7*a*, 7*b*, 7*c*, 8, 9, and 10, an embodiment comprises conveying a part of the liquor 300 from the first outlet 210 of the vessel 200 to a circulation of the liquor 300 upstream of the pump arrangement 720. Thus, the flow $F_3$ flows through the pump arrangement 720, optionally with the flow $F_0$. At least a part of the flow $F_3$ is conveyed to the injector arrangement 710 as the flow $F_1$.

Correspondingly, the system comprises a pipeline 215 configured to convey the liquor 300 from the vessel 200 to the pump arrangement 720 to be pumped by the pump arrangement 720 back to the vessel 200 through the injector arrangement 710.

Referring to FIG. 5*b* recycling of the liquor can be done by using a secondary injector 295. In such a case, the method comprises conveying a part of the liquor 300 from the first outlet 210 of the vessel 200 a circulation of the liquor 300 downstream of the pump arrangement 720 to be mixed with the circulation of the liquor 300 with a secondary injector 295. Moreover, the secondary injector 295 is arranged upstream from the injector arrangement 710.

Even if not shown in the figures, it would be possible to use both a secondary injector 295 as in FIG. 5*b*, and convey a part of the liquor 300 from the first outlet 210 of the vessel 200 to a circulation of the liquor 300 upstream of the pump arrangement 720 as in e.g. FIG. 5*a*.

In an embodiment, a first mass flow $F_1$ of the liquor 300 is conveyed using the pump arrangement 720 via the injector arrangement 710 to the vessel 200 and a second mass flow $F_2$ of the liquor 300 is conveyed from the vessel 200 for use or to a second treatment stage, optionally via the pump arrangement 720. Typically these flows are substantially constant in time at least when the process is up and running. Moreover, a third mass flow $F_3$ of the liquor 300 may be recycled from a first outlet 210 of the vessel 200 to a circulation of the liquor 300 to a point P that is upstream from the injector arrangement 710 and downstream from a chemical recovery boiler.

FIGS. 7*a*, 7*b*, 7*c*, and 8 refer in particular to oxidation of white liquor of a Kraft process. A proper level of treatment, in particular oxidation, may be checked by measuring the content of a compound or compounds of the liquor. Therefore, referring to FIGS. 2*b* and 7*a*, an embodiment comprises measuring a content of sodium sulphide of the liquor 300 or at least partly oxidized liquor 300, which is in the vessel 200. The embodiment further comprises controlling a mass flow $F_2$ of the liquor 300 that is conveyed from the vessel 200 for use by using the measured content of sodium sulphide of the liquor 300 in the vessel 200. In case oxidation is a two-stage process (see FIG. 7*b*), the sodium sulphide content of the liquor 300 or at least partly oxidized liquor 300, which is in the second vessel 200B can be measured, and the mass flow $F_{2B}$ from the second vessel 200B for use can be controlled by using the measured content of sodium sulphide of the liquor 300 in the second vessel 200B. In case oxidation is a three-stage process (FIG. 7*c*), the sodium sulphide content of the liquor 300 or at least partly oxidized liquor 300, which is in the third vessel 200C can be measured, and the mass flow $F_{2C}$ from the third vessel 200C for use can be controlled by using the measured content of sodium sulphide of the liquor 300 in the third vessel 200C.

Referring to FIGS. 2*b* and 2*c*, a value of a quantity indicative the content or mole fraction of hydrogen sulphide ions ($HS^-$) of the liquor 300 in the vessel 200, may be measured with a sensor arrangement 410. When only one quantity is measured, a single sensor 410 may suffice. However, if values of many quantities indicative the content of hydrogen sulphide ions ($HS^-$) of the liquor 300 in the vessel 200, the sensor arrangement 410 may comprise a plurality of sensors 410.

Figure 11:
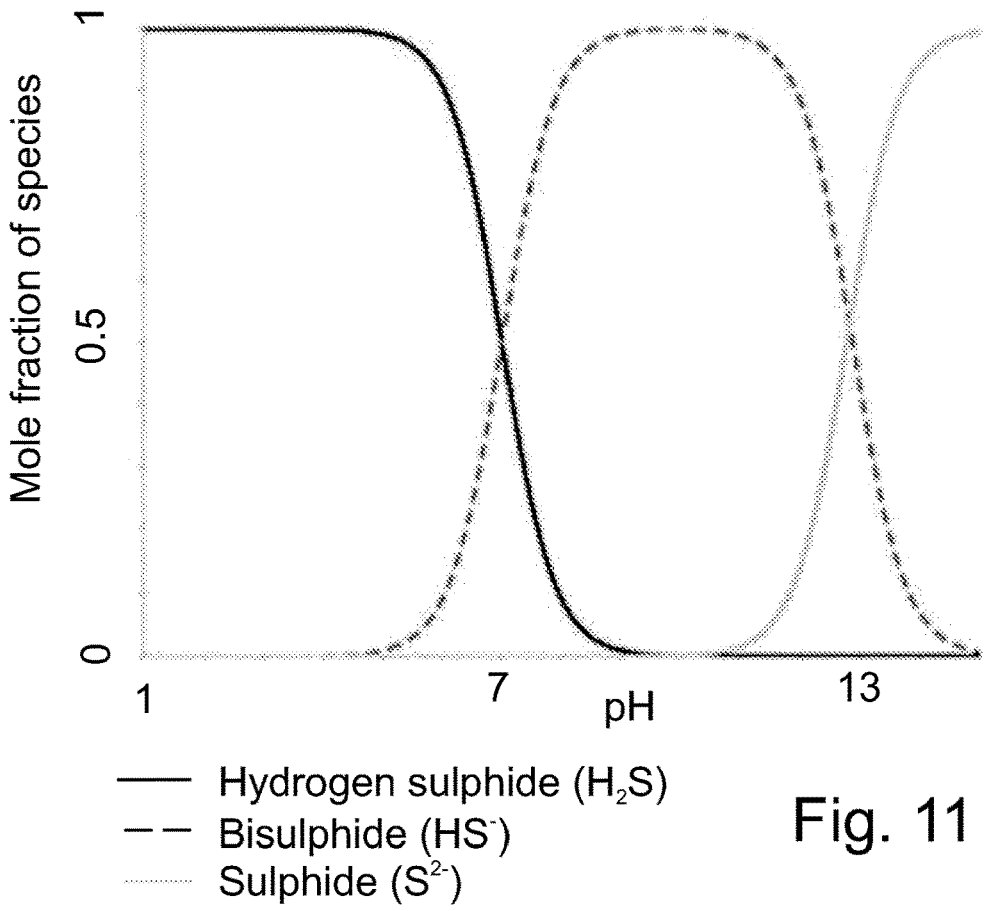
FIG. 11 shows mole fractions of $H_2S$, $HS^-$, and $S^{2-}$ as function of pH of a liquor of a pulp mill process.

The quantity indicative the content or mole fraction of hydrogen sulphide ions ($HS^-$) of the liquor 300 in the vessel 200 may be e.g. the pH of the liquor 300 in the vessel. As indicated in FIG. 11, pH is indicative of the mole fraction. The quantity indicative the content of hydrogen sulphide ions ($HS^-$) of the liquor 300 in the vessel 200 may be e.g. the content of a certain chemical compound of the liquor 300 in the vessel. Examples of such chemical compounds include sodium sulphide (NaS) and sodium thiosulphate ($Na_2S_2O_3$).

Figure 7B:
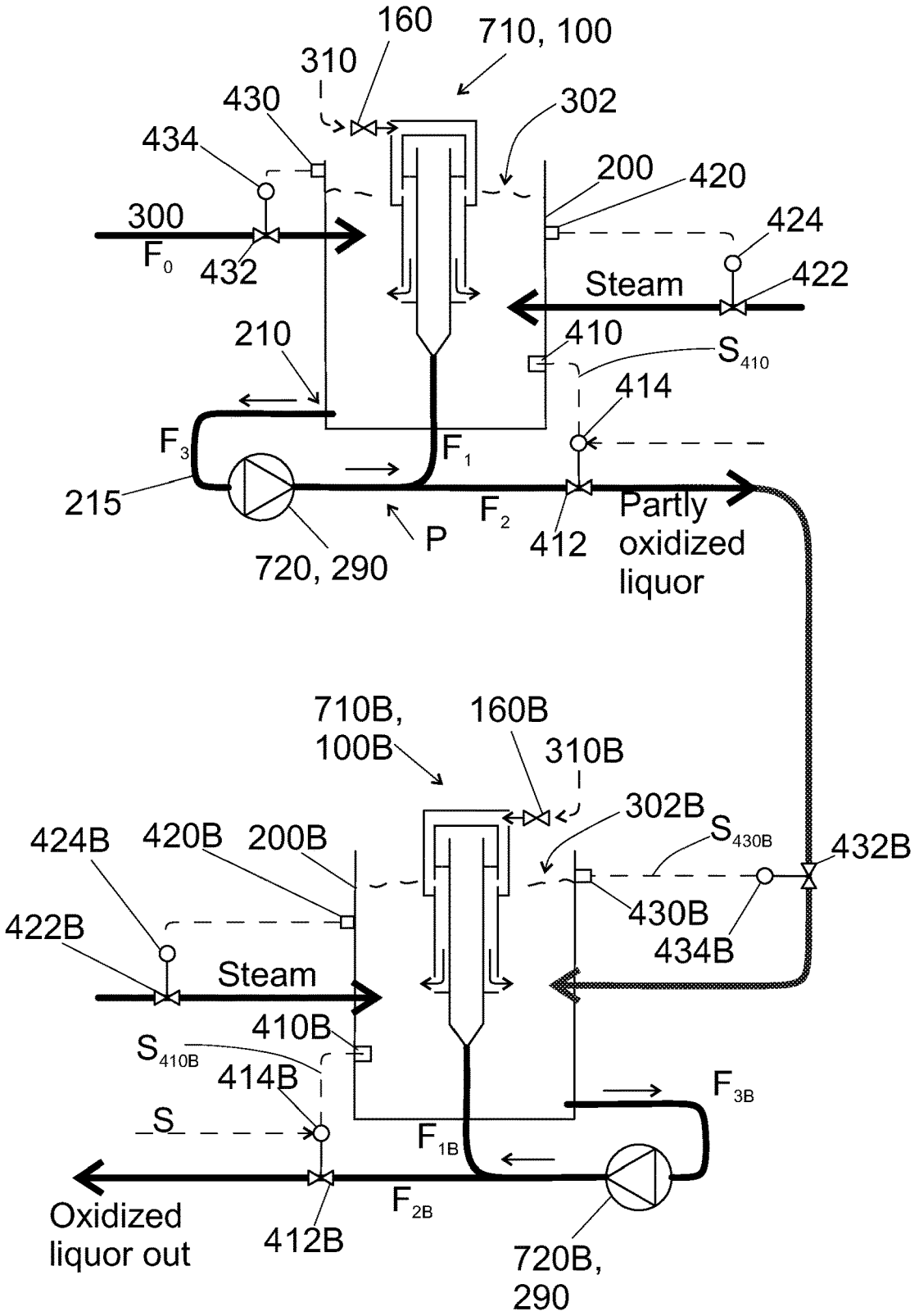
FIG. 7*b* shows a two-stage process and system for oxidizing liquor.
Figure 7C:
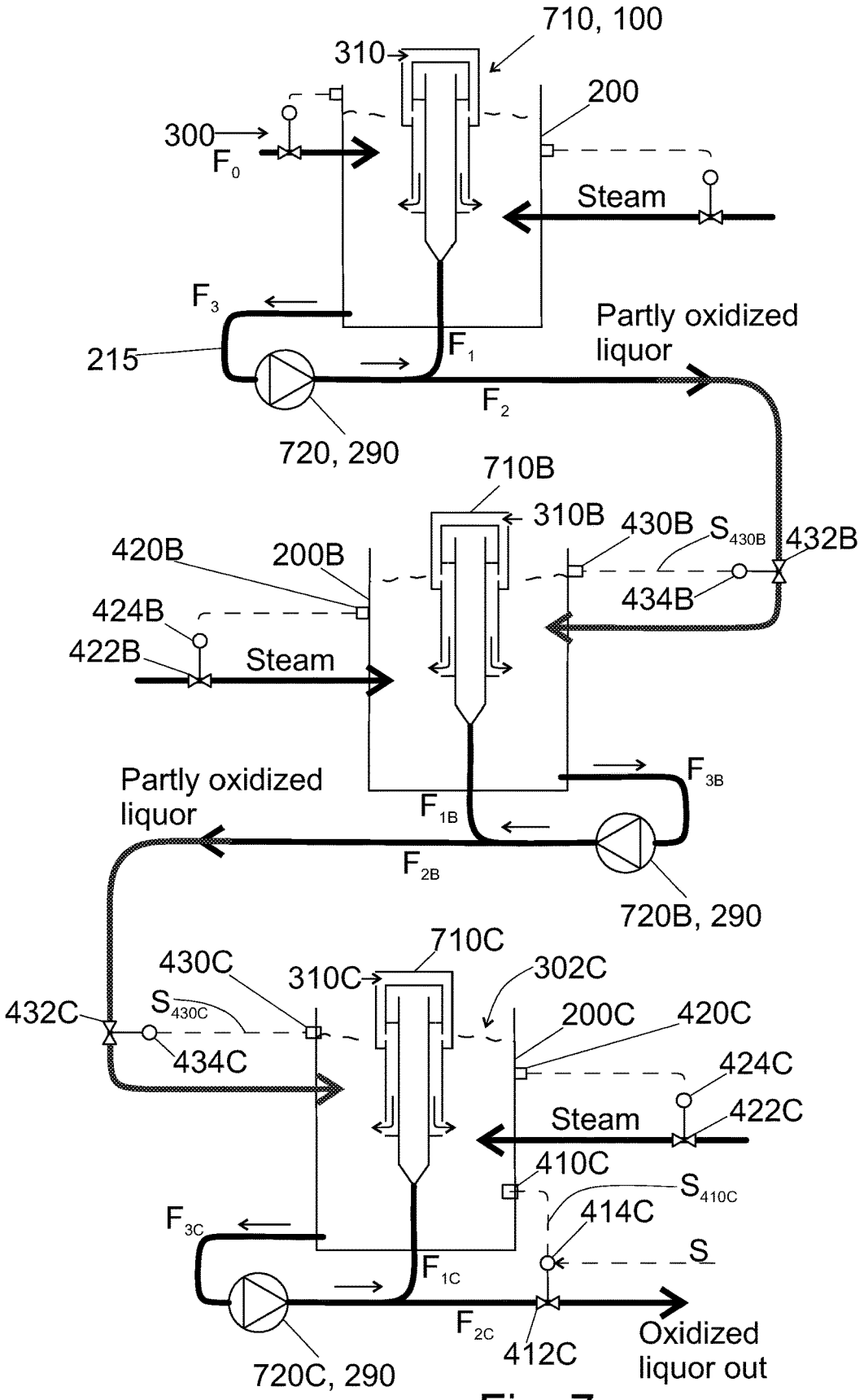
FIG. 7*c* shows a three-stage process and system for oxidizing liquor.

Moreover, the measured value of the quantity indicative the content of hydrogen sulphide ions ($HS^-$) of the liquor 300 in the vessel 200 may be used, e.g. by a controller 414, to control a valve 412 configured to open and close a pipeline 225 for expelling the liquor 300 from the vessel 200, As an example, the content of sodium sulphide of the liquor 300 may be measured with a first sensor 410 (or 410B or 410C) shown in FIGS. 7*a* and 7*b* or 7*c*. The first sensor 410 (or 4108 or 410C) may give a signal $S_{410}$ (or $S_{410B}$ or $S_{410C}$) indicative of the content of sodium sulphide $Na_2S$ of the liquor 300 in the vessel 200 (or second vessel 200B or third vessel 200C). The signal $S_{410}$ (or $S_{410B}$ or $S_{410C}$) may be used to control a valve 412 (or 412B or 412C) configured to let out the liquor for use. A controller 414 (or 414B or 414C) may control the valve 412 (or 412B or 412C), as indicated in FIGS. 2*b* and 7*a* (and 7*b* for a two stage process and 7*c* for a three stage process).

For example, when the system is set up, the vessel 200 of FIG. 2*b* or 7*a* may be filled with the liquor 300. Initially, the liquor 300 in the vessel 200 is not necessarily oxidized to a sufficient level. Thus, the valve 412 may be shut, i.e. controlled in such a way that no liquor is conveyed for use, i.e. $F_2$ would be zero. As for the flows $F_0$, $F_1$, and $F_3$, in this run-up stage, the flow $F_1$ equals the flow $F_3$ (e.g. FIG. 2*b*) or the sum of the flows $F_3$ and $F_0$ (e.g. FIG. 2*c*).

Moreover, when the content of sodium sulphide of the liquor 300, as determined by said the measurement, decreases below a limiting value, such as 1.5 g/l, the valve 412 may be opened to some extent, whereby some of the oxidized liquor 300 will be conveyed for use.

Still further, if, during use, it seems that the content of sodium sulphide of the liquor 300 rises, e.g. above the aforementioned limit or another limit, the valve 412 may be shut in full or in part so as to maintain a sufficiently low level of sodium sulphide.

As an alternative or in addition to the content of sodium sulphide, the content of another compound that is oxidized could be measured. For example, the content of sodium thiosulphate ($Na_2S_2O_3$) could be measured. Moreover, when the content of sodium thiosulphate of the liquor 300, as determined by said measurement, decreases below a limiting value, the valve 412 may be opened to some extent, whereby some of the oxidized liquor 300 will be conveyed for use. The limiting value for sodium thiosulphate may be e.g. 25 g/l or 10 g/l, The valve 412 may be opened e.g. when both the content of sodium sulphide and the content of sodium thiosulphate are low. The values given above apply also in this case. However, measuring the content of sodium thiosulphate alone does not necessarily suffice. If only one vessel is used, both the contents of sodium sulphide and sodium thiosulphate are preferably low. If two vessels are used, only such liquor 300, of which sodium sulphate content is low may be conveyed from a first vessel 200 to a second vessel 200B. In this case, it suffices to measure only the content of sodium thiosulphate of the liquor in the second vessel 200B to check the level of oxidation.

As an alternative or in addition to the content of sodium sulphide and/or thiosulphate, the content of another compound that is oxidized could be measured. Thus, in an embodiment, the compound(s), of which content is/are measured, is such a compound (or compounds) of the liquor 300, that is/are oxidized by reaction with the reagent gas 310 in the injector arrangement 710 and/or the vessel 200. Moreover, as an alternative or in addition, the content(s) of compound(s) resulting from said oxidation could be measured. Thus, e.g. the content of sodium sulphate ($Na_2SO_4$) and/or sodium thiosulphate ($Na_2S_2O_3$) could be measured. For example, the ratio of the content of sodium sulphate ($Na_2SO_4$) to the content of sodium thiosulphate ($Na_2S_2O_3$) may provide reasonable evidence on a degree of oxidation. However, it is noted, that also sodium thiosulphate is such a compound of the liquor 300 that is oxidized by reaction with the reagent gas 310, which in case of oxidation comprises oxygen.

The controller 414 may be configured to operate in a manner described above. When the process is up and running, the flow $F_2$ may be controlled so as to maintain a proper level of oxidation (e.g. sufficiently low content of sodium sulphide and/or sodium thiosulphate), as indicated above.

A proper level of acidification may be checked by measuring the pH of the liquor. A proper level of treatment may be achieved by controlling the amount of recycled liquor 300.

In an embodiment, a ratio $F_2/F_3$ of the second mass flow $F_2$ to the third mass flow $F_3$ is from 5% to 90%, such as from 10% to 90%, such as from 15% to 80%, at least at some point of time. In an embodiment a ratio $\int F_2/\int F_3$ of a time integral $\int F_2$ of the second mass flow $F_2$ to a time integral $\int F_3$ of the third mass flow $F_3$ is from 5% to 90%, such as from 10% to 90%, such as from 15% to 80%, wherein the time integrals are calculated at a same period of time that lasts for at least an hour. As indicated above, it is possible, that during a run-up phase, no liquor is let out from the vessel 200, whereby the flow $F_2$ may be zero initially.

In an embodiment a ratio $F_1/F_3$ of the first mass flow $F_1$ to the third mass flow $F_3$ is from 10% to 90% at least at some point of time. In an embodiment a ratio $\int F_1/\int F_3$ of a time integral $\int F_1$ of the first mass flow $F_1$ to a time integral $\int F_3$ of the third mass flow $F_3$ is from 10% to 90%, wherein the time integrals are calculated at a same period of time that lasts for at least an hour.

However, it is possible to operate to process as a batch process. Thus, it is possible that at all times the liquor 300 is only recycled or only conveyed for use. In such a case, at all times either $F_1$ or $F_2$ is zero. In such a case, the liquid is treated by recycling, until a sufficient level of treatment is achieved. Thereafter, the treated liquor is conveyed for use, but not further treated by recycling.

As indicated above, in the embodiments of FIGS. 2*b*, 7*a*, 7*b*, and 7*c*, these ratios can be controlled with the valve 412. Referring to FIGS. 5*a*, 5*b*, 6*a*, 6*b*, 6*c*, and 6*d*, in another embodiment, these ratios can be controlled e.g. with at least one of the valves 162, 164. In the embodiment of FIG. 5*b*, the valve 162 is not needed, since the same effect can be obtained by controlling the pump arrangement 720. Moreover, In the embodiments of FIGS. 5*a*, 6*a*, 6*b*, 6*c*, and 6*d*, one of the valves 162, 164 may suffice for controlling the amount of recycled liquor 300.

Referring to FIGS. 2, 5*a*, 5*b*, 6*a*, 6*b*, 6*c*, and 6*d*, an embodiment comprises conveying a part of the liquor 300 from a second outlet 220 of the vessel 200 to a point of use, wherein the second outlet 220 of the vessel 200 is arranged at a lower part of the vessel 200. As indicated above, typically in the lower parts of the vessel 200 the liquor 300 is free from bubbles 320, whereby this has the technical effect the all the bubbles 320 are utilized for treatment of the liquor 300 within the vessel 200. In other words, substantially no gas bubbles 320 are conveyed to use. Preferably the second outlet 220 of the vessel 220 is arranged at a bottom of the vessel 200.

However, referring to FIGS. 2*b*, 7*a*, 7*b*, 7*c*, 8, 9, and 10 the at least partly treated liquor can be conveyed to a point of use from a secondary circulation of the liquor 300.

Referring to FIGS. 5*a*, 5*b*, 6*a*, 6*b*, 6*c*, and 6*d* in an embodiment the vessel 200 comprises a wall 230 separating the vessel to a first compartment 232 and a second compartment 234. The wall 230 limits a passage 236 above the wall 230, wherein the passage 236 is configured to convey the liquor 300 from the first compartment 232 to the second compartment 234. The injector arrangement 710 is arranged in the first compartment 232 of the vessel 200. Moreover, the second compartment comprises 234 the second outlet 220 of the vessel 220. Furthermore, if some of the liquor 300 is recycled, as indicated above, preferably the first outlet 210 is arranged in the first compartment 232.

This has the technical effect that only well oxidized liquor 300 flows from the first compartment 232 to the second compartment 234. In effect, the liquor 300 drawn from the second outlet 220 of the vessel 200 is well oxidized. Preferably also in this case the second outlet 220 of the vessel 220 is arranged at a lower part of the second compartment 234 such as at a bottom of the second compartment 234.

However, a similar effect can be achieved by using at least to vessels (200, 200B, 200C), as indicated in FIGS. 7*b*, 7*c*, 8, and 9.

Referring to FIG. 7*b*, in an embodiment, at least the first vessel 200 and a second vessel 200B are arranged in sequence. In the first vessel 200 (i.e. a first stage), the liquor 300 is treated as indicated above in connection with FIG. 7*a*. The partly treated (e.g. oxidized and/or acidified) liquor is conveyed to the second vessel 200B (i.e. a second stage). Moreover, in the second vessel 200B, the liquor 300 is further treated using the principles discussed above for the vessel 200.

More precisely, an embodiment comprises conveying at least partly treated liquor 300 from the first vessel 200 into a second vessel 200B. The method further comprises pumping the at least partly treated liquor 300 to a second injector arrangement 710B using a second pump arrangement 720B, thereby generating suction and mixing second reagent gas 310B with the at least partly treated liquor 300. The liquor 300 is let out from the second injector arrangement 710B to the second vessel 200B, whereby the liquor 300 is further treated. The second injector arrangement 710B comprises at least an injector 100. Finally the liquor 300 may be conveyed to a point of use or to a subsequent treatment stage from the second vessel 200B.

As indicated in the FIGS. 7*a* and 7*b*, a corresponding system comprises a first vessel 200 configured to receive the liquor 300, a first pump arrangement 720, and an first injector arrangement 710 comprising at least one primary injector. The at least one primary injector comprises a first chamber 110 configured to receive the liquor 300 from the first pump arrangement 720, a jet nozzle 115 for forming a primary jet 116 of the liquor 300, and a gas inlet passage 130 configured to convey first reagent gas 310 to be mixed with the primary jet 116. The primary injector 100 is arranged to let out the liquor 300 into the first vessel 200. The first pump arrangement 720 is configured to pump the liquor 300 through the first injector arrangement 710 to the first vessel 200.

The system further comprises a second vessel 200B configured to receive the liquor 300, a second pump arrangement 720B, and an second injector arrangement 710B comprising at least one secondary injector. The at least one secondary injector comprises a first chamber configured to receive the liquor 300 from the second pump arrangement 720B, a jet nozzle for forming a secondary jet of the liquor 300, and a gas inlet passage configured to convey second reagent gas 310B to be mixed with the secondary jet 116. The secondary injector is arranged to let out the liquor 300 into the second vessel 200B. The second pump arrangement 720B is configured to pump the liquor 300 through the second injector arrangement 710B to the second vessel 200B.

Moreover, the system comprises a pipeline configured to convey the liquor from the first vessel 200 to the second vessel 200B.

In an embodiment, the same gas is used as the first reagent gas 310 and as the second reagent gas 310B. In another embodiment, wherein the liquor 300 is oxidized, the oxygen content of the second reagent gas 310B is greater than the oxygen content of the first reagent gas 310. For example, the second reagent gas 310B may comprise at least 50 vol %, at least 75 vol %, or at least 90 vol % oxygen. Such a higher oxygen content may improve oxidation of e.g. sodium thiosulphate to form sodium sulphate. In the prior art two-stage oxidation has not been applied, because the vessel used in the prior art (see FIGS. 1*a* and 1*b*) is so large that a plant could not practically fit two vessels, one for each stage. In contrast, in the embodiments of the present invention, the vessels can be made much smaller, whereby a two-stage process (FIG. 7*b*), a three-stage process (FIG. 7*c*), or even a multi-stage process becomes feasible.

Figure 8:
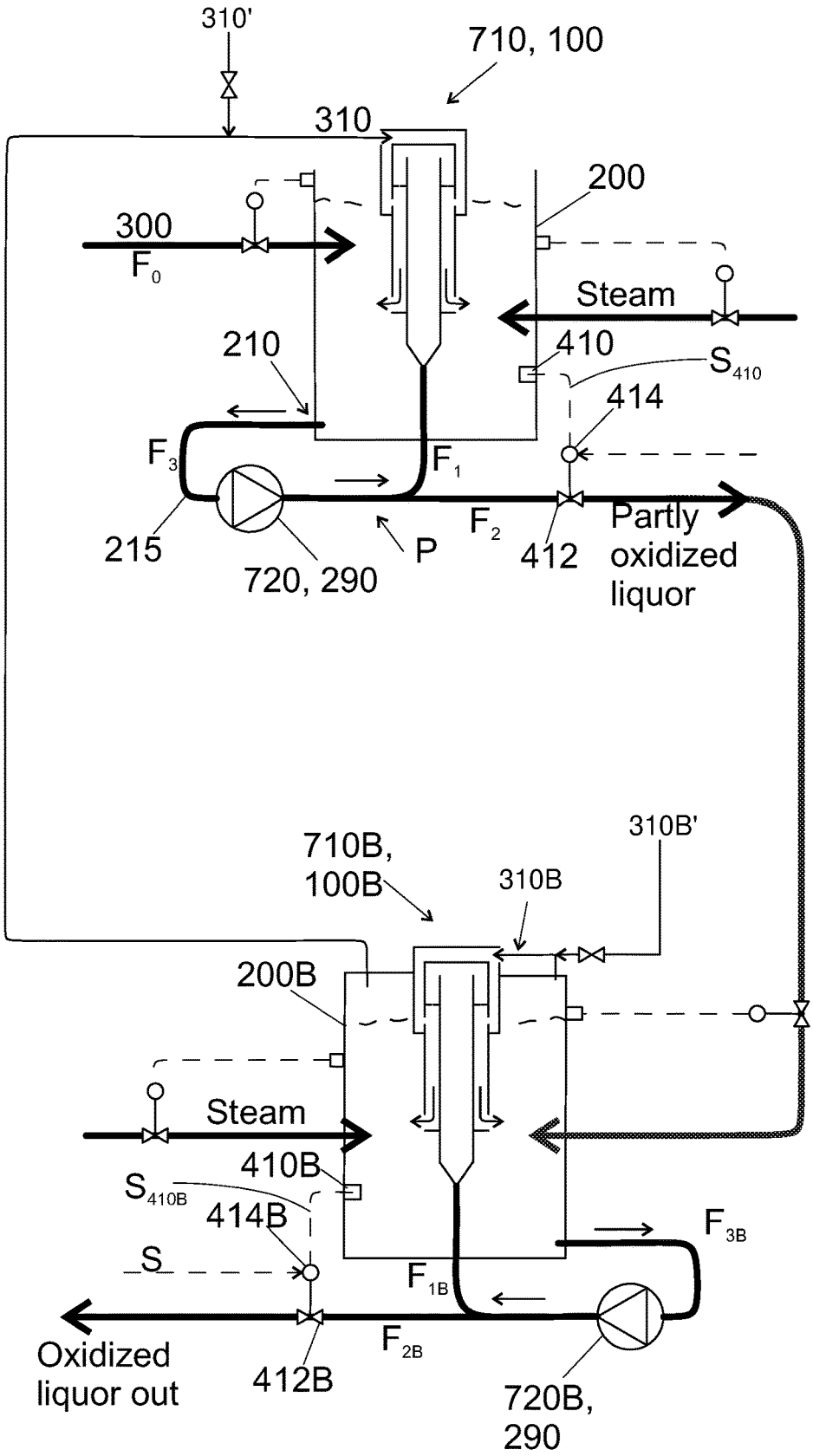
FIG. 8 shows a two-stage process and system for oxidizing liquor and recycling of reagent gas.

If the oxygen content of the second reagent gas 310B is higher than that or air, it may be feasible to recycle also the reagent gas 310, 310B. The reagent gas can be recycled to the second stage (i.e. second injector arrangement 710B) and/or to the first stage (i.e. the first injector arrangement 710). Such an embodiment is shown in FIG. 8. The embodiment comprises conveying some gas from an upper part of the second vessel 200B to be used as part of the first reagent gas 310 in the first injector arrangement 710 (of which a part is arranged in the first vessel 200). A method may further comprise conveying some gas from an upper part of the second vessel 200B to be used as part of the second reagent gas 310B. Such recycling may be used in addition or alternatively in first vessel 200, too, also in the case of only a one-stage process. Thus, an embodiment comprises conveying some gas from an upper part of the first vessel 200 to be used as part of the first reagent gas 310 (see FIG. 10).

Referring to FIG. 8 in an embodiment, the second reagent gas 310B is a mixture of a second feed gas 310B' and the gas taken from an upper part of the second vessel 200B. The second feed gas 310B' may be oxygen rich, for example its oxygen content may be at least 50 vol %. Referring to FIG. 8 in an embodiment, the first reagent gas 310 is a mixture of a first feed gas 310' and the gas taken from an upper part of the second vessel 200B. The first feed gas 310' may comprise, but need not comprise, oxygen, as detailed in connection with FIG. 9. The second feed gas 310B' need not comprise oxygen.

A sensor 410B may be configured to measure a content of at least a compound (e.g. sodium sulphide and/or sodium thiosulphate) of the liquor 300 in the second vessel 200B. The sensor 410B may give a signal $S_{410B}$ indicative of the content(s) of the compound(s) of the liquor 300 in the second vessel 200B. The signal $S_{410B}$ may be used to control a valve 412B configured to let out the liquor from the second vessel 200B for use. A controller 414B may control the valve 412B, as indicated in FIG. 7*b*. However, such a sensor 410B is not necessary needed, since the content the compound (e.g. sodium sulphide and/or sodium thiosulphate) may be measured alternatively or in addition from the liquor 300 of first vessel 200. Thus, the system may ensure that only such liquor that is sufficiently oxidized, will be conveyed to the second vessel 200B. As indicated above, the system of FIG. 7*b* may comprise only either one of the sensors 410, 410B, or both of them.

The first vessel 200 and the second vessel 200B may share a common wall. For example a wall, such as a wall 230, may divide a large vessel to sections that serve as the vessels 200 and 200B.

It is also possible that [i] the content of sodium sulphide $Na_2S$ of the liquor 300 is measured with a primary first sensor 410 configured to give a signal $S_{410}$ indicative of the content of sodium sulphide of the liquor 300 in the first vessel 200 and [ii] the content of sodium thiosulphate ($Na_2S_2O_3$) of the liquor 300 is measured with a secondary first sensor 410B configured to give a signal $S_{410B}$ indicative of the content of sodium thiosulphate of the liquor 300 in the second vessel 200B. Thus, the controller 414 may operate the valve 412 in such a way that only such liquor, of which sodium sulphide content is sufficiently low, is passed to the second stage (i.e. the second vessel 200B). Moreover, the controller 414B may operate the valve 412B is such a way that only such liquor, of which sodium thiosulphate content is sufficiently low, is passed from the second stage (e.g. to use a to a third vessel 200C). For example, the controller 414 may open the valve 412, when the measured content of sodium sulphide is less than 1.5 g/l and the controller 414B may open the valve 412B, when the measured content of sodium thiosulphate is less than a limiting value, such as 10 g/l or 25 g/l. The controllers 414 and 414B may belong to a same single controller arrangement.

As for recycling the liquor of the second vessel 200B, what has been said above for the flows $F_1$, $F_2$, $F_3$ and their ratios applies to the flows $F_{1B}$, $F_{2B}$, and $F_{3B}$, respectively (see FIGS. 7*b* and 7*c*).

As indicated in FIG. 7*c*, if needed, the liquor 300 may be yet further treated (e.g. oxidized or acidified) in a third vessel 200C (i.e. a third stage). Thus, an embodiment comprises conveying at least partly treated liquor 300 from the second vessel 200B into a third vessel 200C. The embodiment further comprises pumping the at least partly treated liquor 300 to a third injector arrangement 710C using a third pump arrangement 7200, thereby generating suction and mixing third reagent gas 310C with the at least partly treated liquor 300. The liquor 300 is let out from the third injector arrangement 710C to the third vessel 2000, whereby the liquor 300 is further treated. The third injector arrangement 710C comprises at least an injector 100. Finally the liquor 300 may be conveyed to a point of use from the third vessel 200C. Even if not shown, subsequent treatment stages may be used in a similar manner, whereby the liquor 300 may be conveyed from the third vessel 200C to a subsequent vessel.

The first vessel 200 and the third vessel 200C may share a common wall. The second vessel 200B and the third vessel 200C may share a common wall.

In an embodiment, the same gas is used as the second reagent gas 310B and as the third reagent gas 310C. In another embodiment, the oxygen content of the third reagent gas 310C is greater than the oxygen content of the second reagent gas 310B. For example, the third reagent gas 310C may comprise at least 50 vol %, at least 75 vol %, or at least 90 vol % oxygen, e.g. in order to oxidize sodium thiosulphate to sodium sulphate. An embodiment comprises conveying some gas from an upper part of the third vessel 200C to be used as part of the second oxygen containing gas 3108 in the second injector arrangement 710B (of which a part is arranged in the second vessel 200B).

Referring to FIG. 7*c*, a sensor 410C may be configured to measure content(s) of at least a compound (e.g. sodium sulphide and/or sodium thiosulphate) of the liquor 300 in the third vessel 200C. The sensor 410C may give a signal $S_{410C}$ indicative of the content of the compound(s) of the liquor 300 in the third vessel 200C. The signal $S_{410C}$ may be used to control a valve 412C configured to let out the liquor from the third vessel 200C for use. A controller 414C may control the valve 412C, as indicated in FIG. 7*c*.

As for recycling the liquor of the third vessel 200C, what has been said above for the flows $F_1$, $F_2$, $F_3$ and their ratios applies to the flows $F_{1C}$, $F_{2C}$, and $F_{3C}$, respectively.

Referring to FIG. 4*b*, preferably the bubbles 320 of the reagent gas 310 within the liquor 300 are small. Naturally the bubbles are not all of the same size.

In an embodiment, the liquor 300 is pumped to the vessel 200 via the injector arrangement 710 in such a way that an average diameter d of the bubbles 320 of the reagent gas 310 is at most 5 mm such as from 0.5 mm to 4 mm. This size refers to the average diameter as observable at the outlet(s) 140 of the injector(s) 100 of the injector arrangement. The average may be calculated as a number average, i.e. all bubbles have the same weight in the calculation of the average regardless of their size.

In addition to the collision element 117 of the injector 100, the mass flow $F_1$ of the liquor through the injector arrangement 710 affects the size d of the bubbles 320. In general, the larger the flow (per an injector), the smaller the bubbles 320. Therefore, the number of the injectors 100 of an injector arrangement 710 may be selected such that bubbles of suitable size are generated for the designed liquor flow $F_1$. Naturally, the structural details of the injector 100, such as the size and number of the orifices of the jet nozzles, also affect the size of the bubbles 320. Moreover, in an embodiment, the liquid 300 is pumped through the injector arrangement with such a mass flow $F_1$, that the aforementioned average diameter d of the bubbles 320 of the reagent gas 310 is within the aforementioned limit.

The average diameter d of the bubbles 320 of the reagent gas 310 has been found to correlate with the velocity of the liquid 300 within the jet 116. At least for a reasonably wide range of velocities, the larger the velocity, the smaller the bubbles. Thus, in an embodiment, the liquor 300 is pumped to the vessel 200 via the injector arrangement 710 in such a way that a velocity of the liquor 300 in the jet 116 is at least 5 m/s. However, a large velocity within the jet requires high pressure and thus consumes energy and requires special material design. Therefore, too high velocities are not preferred. Therefore, in an embodiment, the liquor 300 is pumped to the vessel 200 via the injector arrangement 710 in such a way that a velocity of the liquor 300 in the jet 116 is from 5 m/s to 10 m/s (relative to the vessel 200).

In an embodiment the liquor 300 comprises sodium sulphide ($Na_2S$). As a result of oxidation of the liquor 300, at least some of the sodium sulphide is oxidized to sodium thiosulphate ($Na_2S_2O_3$) and, optionally, further to sodium sulphate ($Na_2SO_4$). Oxidization occurs by chemical reaction of the liquor 300 with said reagent gas 310 (and/or second reagent gas 310B and/or third reagent gas 310C). As for the level of oxidation, an embodiment comprises receiving liquor 300 having a sodium sulphide ($Na_2S$) content of from 25 g/l to 60 g/l and oxidizing the received liquor 300 using the pump arrangement 720, the injector arrangement 710, and the vessel 200 in such a way that the sodium sulphide ($Na_2S$) content of the liquor 300 in the vessel 200 is less than 3 g/l, or less than 1.5 g/l. As indicated above, the content of sodium sulphide ($Na_2S$) decreases as a result of oxidation.

As is clear, the high content of sodium sulphide ($Na_2S$) refers to the content of sodium sulphide ($Na_2S$) before oxidization, i.e. content of the un-oxidized liquor 300 of the primary circulation before the first vessel 200 of the oxidation. In particular, if some of the liquor 300 is recycled, the high sodium sulphide ($Na_2S$) content refers to a content of the flow $F_0$. In other words, the high sodium sulphide ($Na_2S$) content refers to a content of the liquor at a point upstream from the point P as defined above and towards a liquor source different from the vessel 200, such as a causticizer or a chemical recovery boiler. The aforementioned low content may be ensured e.g. by the first sensor 410 as detailed above.

The rate of the oxidation reaction depends on temperature, and in general the temperature of the liquor 300 should be at least 80° C. for proper oxidation. The oxidation reaction is exothermic. Thus, when up and running, the temperature is, in general, not a problem. However, when the process starts, typically the liquor 300 and/or the reagent gas 310 needs to be heated for proper level of oxidation. Thus, an embodiment comprises heating the liquor 300 to a temperature of at least 60° C. Alternatively or in addition, the reagent gas 310 can be heated before in it is mixed with the liquor 300 in the injector arrangement 710. The reagent gas 310 can be heated before in it is mixed with the liquor 300 in the injector arrangement 710 e.g. to a temperature of at least 60° C.

Preferably, the liquor 300 is heated by injecting steam into the vessel 200. This is indicated in FIGS. 5*a*, 6*a*, 7*a*, 7*b*, and 7*c*, even if steam can be used in a similar manner also in other embodiments. Moreover, the feeding of steam may be controlled so that it is used only when needed. Therefore, an embodiment comprises measuring a temperature of the liquor 300 or the at least partly treated liquor 300, which is in the vessel 200. Moreover, provided that the measured temperature is less than a temperature limit, the embodiment comprises heating the liquor 300 or the treated liquor 300. The liquor may be heated to at least 60° C. or to at least 80° C. Preferably, the liquor 300 is heated by injecting steam into the vessel 200. In the alternative or in addition, the reagent gas 310 could be heated. A temperature sensor 420 can be used to measure the temperature of the liquor 300 in the vessel 200. The flow of steam can be controlled using the valve 422 and optionally with a controller 424.

In an embodiment, the liquor 300 or the treated liquor 300 is heated by injecting steam into the vessel 200 only when the measured temperature is less than the temperature limit. The temperature limit may be at least 60° C., such as from 60° C. to 95° C. In an embodiment, the temperature of the liquor 300 in the vessel 200 is from 80° C. to 98° C. at least at some point of time.

As indicated in FIGS. 7*b* and 7*c*, the liquor 300 in the second vessel 200B and/or the liquor 300 in the third vessel 200C can be heated in a similar manner. The temperature sensors 422B and 422C and optionally the controllers 424B and 424C can be used for the purpose. The temperature of the liquor 300 in the second vessel 200B may be in the limits disclosed for the temperature of the liquor 300 in the vessel 200. The temperature of the liquor 300 in the third vessel 200C may be in the limits disclosed for the temperature of the liquor 300 in the vessel 200.

Figure 1B:
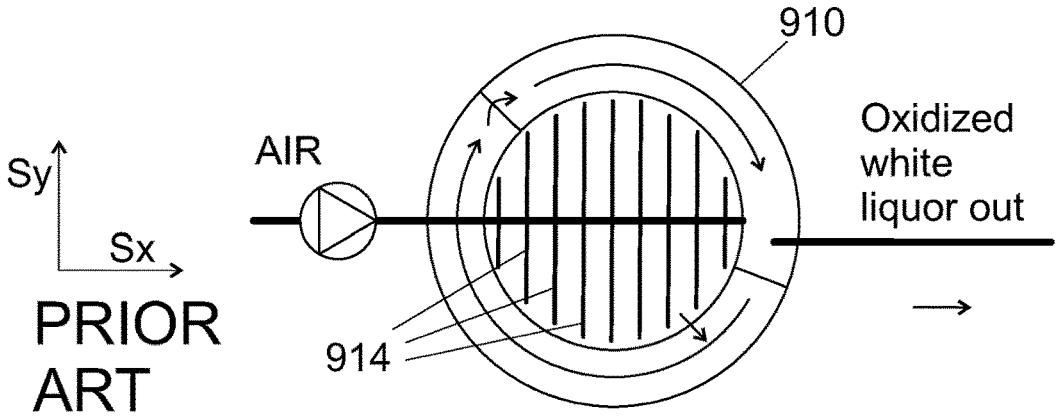
FIG. 1*b* shows, in a top view, the system of FIG. 1*a*.

As indicated above, the method may be performed by retrofitting an injector arrangement 710 to the vessel 200 of a prior art solution of FIG. 1. Such a retrofitted system is indicated in FIGS. 5*a* and 5*b*. In such systems, the vessel 200 is typically cylindrical as indicated in FIG. 1*b*, and the first compartment 232 of the vessel 200 is located closer to a central axis of the cylindrical vessel 200 than the second compartment 234.

Alternatively, a new design may be used, as indicated in FIGS. 6*a*, 6*b*, 6*c*, and 6*d*. Therein the vessel 200 needs not to be cylindrical. As shown in these figures, the injector arrangement 710 may be arranged at a first side of the vessel 200 in a first compartment 232. The second liquor outlet 220 may be arranged at a second, opposite, side of the vessel 200, in a second compartment 234.

Figure 6B:
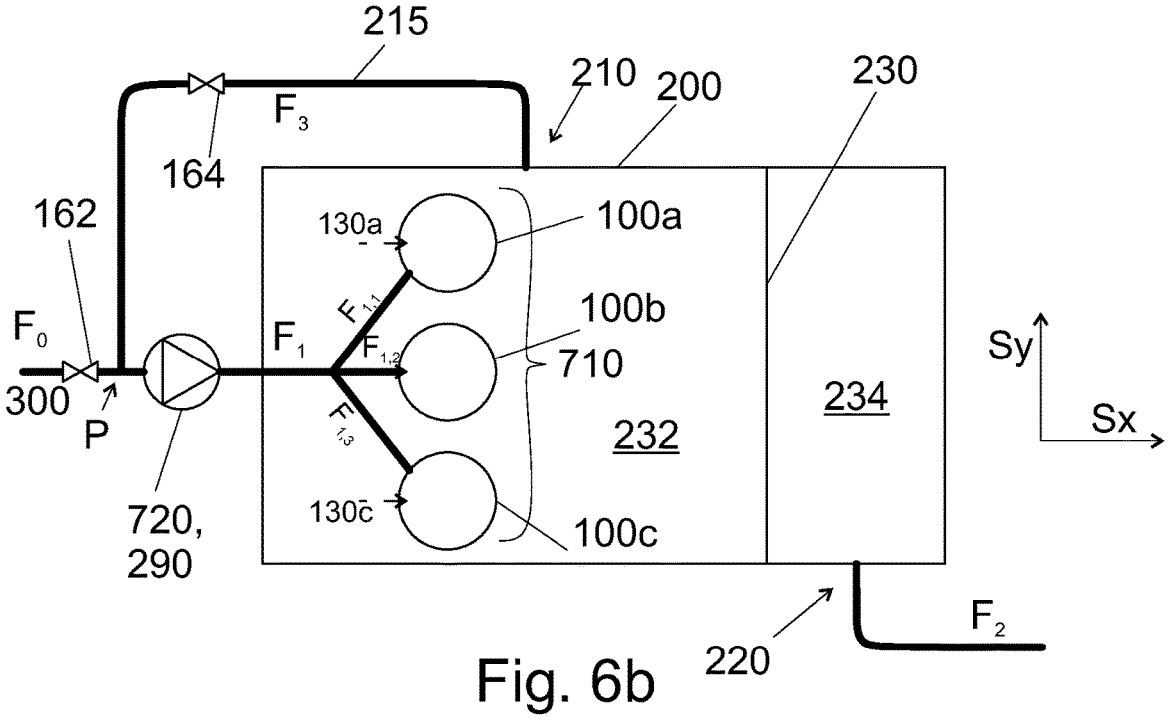
FIG. 6*b* shows, in a principal top view, the system of FIG. 6*a*.

FIGS. 6*a* and 6*b* show an embodiment, wherein the pump arrangement 720 comprises only one pump 290, and the injector arrangement 710 comprises three injectors 100*a*, 100*b*, 100*c*. The flow $F_1$ from the pump arrangement 720 is divided to the flows $F_{1,1}$, $F_{1,2}$, and $F_{1,3}$ such that the flow $F_{1,1}$ runs through the first injector 100*a*, the flow $F_{1,2}$ runs through the second injector 100*b*, and the flow $F_{1,3}$ runs through the third injector 100*c*. These flows can be controlled with valves, if needed. In such an embodiment, a larger flow may be used also when the injectors are small in size. In an embodiment, the injector arrangement 710 comprises at least two injectors 100*a*, 100*b*. In an embodiment, the injector arrangement 710 comprises at least three injectors 100*a*, 100*b*, and 100*c*. FIG. 6*b* also shows the air inlets 130*a* and 130*c* of the injectors 100*a* and 100*c*, respectively.

Figure 6C:
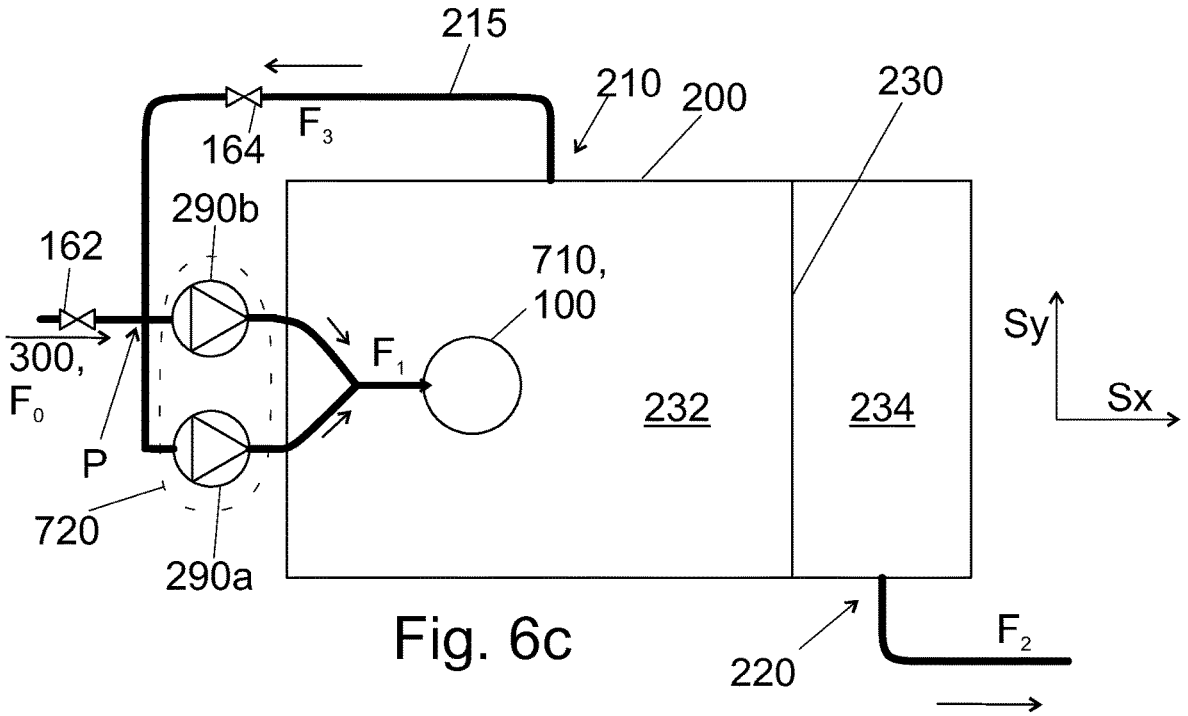
FIG. 6*c* shows, in a principal top view, a system for removing hydrogen sulphide ions ($HS^-$) from a liquor of a pulp mill process, the system comprising a pump arrangement with two pumps and an injector.
Figure 6D:
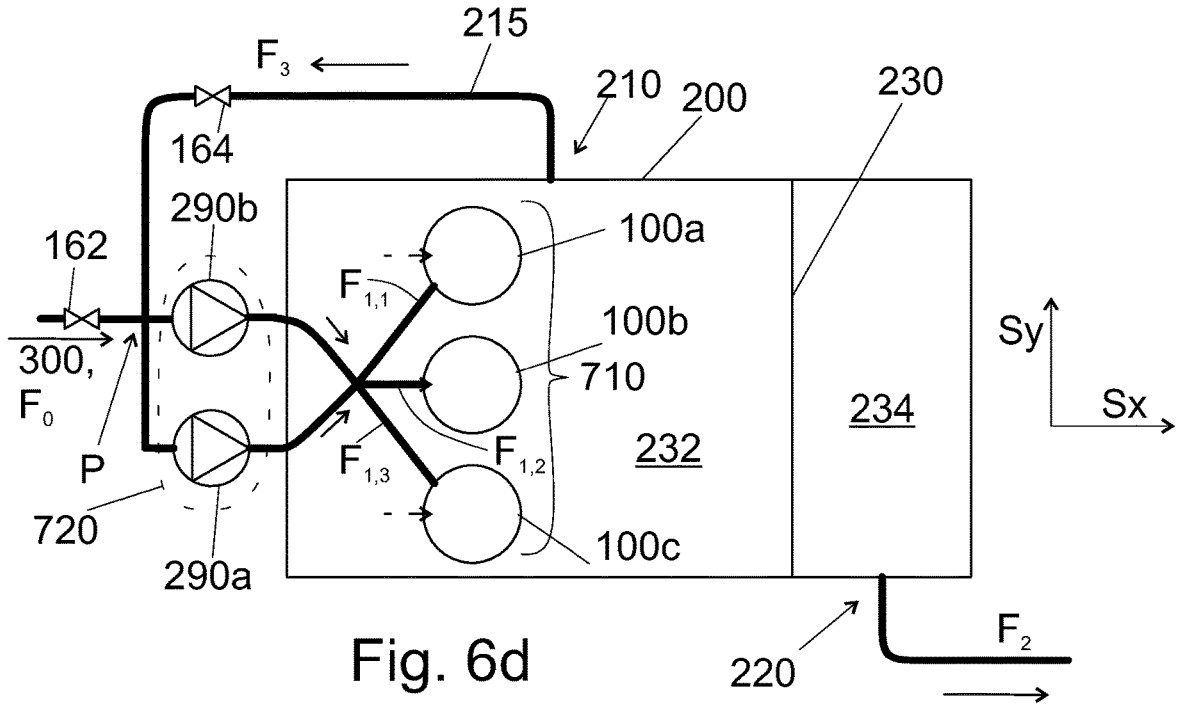
FIG. 6*d* shows, in a principal top view, a system for removing hydrogen sulphide ions ($HS^-$) from a liquor of a pulp mill process, the system comprising a pump arrangement with two pumps and an injector arrangement with three injectors.

FIG. 6*c* shows an embodiment, wherein the pump arrangement 720 comprises two pumps 290*a* and 290*b*, and the injector arrangement 710 comprises only one injector 100. FIG. 6*d* shows an embodiment, wherein the pump arrangement 720 comprises two pumps 290*a* and 290*b*, and the injector arrangement 710 comprises three injectors 100*a*, 100*b*, 100*c*. The flow from the pump arrangement 720 is divided to three flows $F_{1,1}$, $F_{1,2}$, and $F_{1,3}$ such that the flow $F_{1,1}$ runs through the first injector 100*a*, the flow $F_{1,2}$ runs through the second injector 100*b*, and the flow $F_{1,3}$ runs through the third injector 100*c*. These flows can be controlled with valves, if needed. In the embodiments of FIGS. 6*c* and 6*d*, both or only one of the pumps 290*a*, 290*b* may be used, depending on the need. In addition or alternatively, one of the pumps 290*a*, 290*b* may be used while the other one 290*b*, 290*a* is maintained.

Even if not explicitly shown, in the embodiments, in particular in the embodiments of FIGS. 7*a*, 7*b*, 7*c*, 8, 9, and 10, the injector arrangement 710, i.e. first injector arrangement 710, may comprise one, two, three, four, or more than four injectors 100. The second injector arrangement 710B may comprise one, two, three, four, or more than four injectors 100. The third injector arrangement 710C may comprise one, two, three, four, or more than four injectors 100.

Even if not explicitly shown, in the embodiments, in particular in the embodiments of FIGS. 7*a*, 7*b*, 7*c*, 8, 9, and 10, the pump arrangement 720, i.e. the first pump arrangement 720, may comprise one, two, three, four, or more than four pumps 290. The second pump arrangement 720B may comprise one, two, three, four, or more than four pumps 290. The third pump arrangement 720C may comprise one, two, three, four, or more than four pumps 290.

The surface 302 of the liquor 300 within the vessel 200 should be at a proper height during use. If the vessel 200 does not comprise a lid or a roof, as in FIG. 7*a*, over-filling would result in the liquor running out of the vessel 200 from top. Moreover, when air is used as the reagent gas, the surface 302 of the liquor 300 should be so low that at least part of the gas inlet passage 130 remains above the surface 302 in order to take air in to the gas inlet passage 130. However, as indicated in FIGS. 6*a* and 7*a*, a gas inlet of the gas inlet passage 130 may be arranged above the vessel 200. Moreover, as indicated in FIG. 6*a*, the vessel 200 may be equipped with a lid, whereby the vessel 200 cannot be over-filled.

For these reasons, and referring to FIGS. 2*c*, 7*a* and 7*b*, an embodiment comprises measuring a level of a surface 302 of the liquor 300 in the vessel 200 and controlling a mass flow $F_0$ of the liquor 300 that is conveyed to the vessel 200 by using the measured level of a surface 302 of the liquor 300 in the vessel 200. As indicated above, the mass flow $F_0$ refers to the flow of liquor 300 to be treated. For this purpose, the system may comprise a surface level sensor 430 and a valve 432, 162 configured to limit the mass flow $F_0$ of the liquor 300 to be treated. In addition, the system may comprise a controller 434 configured to control the valve 432, 162 configured to limit the mass flow $F_0$, the controller 434 configured to control the valve 432, 162 by using a signal received from the surface level sensor 430. Liquor 300 may be let in to the vessel 200 through the valve 432, 162 only when the level of the surface 302 is low enough as evidenced by a signal of the surface level sensor 430.

Moreover, preferably, the liquor 300 is ejected to the vessel 200 through the injector arrangement 710 so that an outlet 140 (see FIG. 4*a*) of the injector for the liquor 300 remains under the surface 302 of the liquor 300. This does not necessarily apply during a run-up of the system, but preferably applies at least at some instance of time. Thus, the system may comprise a second surface level sensor 435, as indicated in FIG. 6*a*. The pump arrangement 720 may be configured to pump only when the level of the surface 302 is high enough as evidenced by a signal $S_{435}$ of the second surface level sensor 435. The pump arrangement 720 may comprise a controller (not shown) for the purpose.

In addition or alternatively, the system may comprise a valve 412 for controlling the flow of the treated liquor for use. Referring to FIGS. 2*b* and 7*a*, an embodiment comprises controlling a mass flow $F_2$ of the liquor 300 that is conveyed from the vessel 200 for use. Referring to FIG. 7*b*, an embodiment comprises controlling a mass flow $F_{2B}$ of the liquor 300 that is conveyed from the second vessel 200B for use. Referring to FIG. 7*c*, an embodiment comprises controlling a mass flow $F_2c$ of the liquor 300 that is conveyed from the third vessel 200C for use. In addition, the flow $F_2$, $F_{2B}$, $F_{2C}$ may be controlled with a controller 414, 414B, 414C, respectively. Furthermore, the controller 414, 414B, 414C may receive a signal S indicative of a need for the oxidized liquor 300. Thus, an embodiment comprises receiving a signal S indicative of a need for the treated liquor 300 and controlling a mass flow ($F_2$, $F_{2B}$, $F_{2C}$) of the for use by using the signal S. The liquor 300 may be conveyed for use from the vessel 200 or from the second vessel 200B or from the third vessel 200C; or from another vessel e.g. when more stages are used.

Referring to FIGS. 7*b* and 7*c*, in an embodiment, wherein the oxidation is performed in at least two stages, the flow $F_2$ of the partly oxidized liquor 300 from the first vessel 200 to the second vessel 200B may be controlled using a valve 432B. Moreover, this valve may be controlled by a controller 434B. The controller 434B may control the valve 432B by using a signal $S_{430B}$ indicative of a level of a surface 302B of the liquor 300 in the second vessel 200B. The controller 434B may receive the signal $S_{430B}$ from a sensor 430B configured to detect a level of a surface 302B of the liquor 300 in the second vessel 200B. As is evident, two separate valves 412, 432B, and two separate controllers 414, 434B are not needed in the embodiment of FIG. 7*b*. In an embodiment, a controller arrangement (414, 434B) is configured to control a valve arrangement (432B, 412) by using signals ($S_{430B}$, $S_{410}$) indicative of content(s) of at least a compound of the liquor in the first vessel 200 and a level of a surface 302B of the liquor 300 in the second vessel 200B, wherein the valve arrangement (432B, 412) is configured to limit the flow from the first vessel 200 to the second vessel 200B.

Referring to FIG. 7*c*, in an embodiment, wherein the oxidation is performed in three stages, the flow $F_{2B}$ of the partly oxidized liquor 300 from the second vessel 200B to the third vessel 200C may be controlled using a valve 432C. Moreover, this valve may be controlled by a controller 434C. The controller 434C may control the valve 432C by using a signal $S_{430C}$ indicative of a level of a surface 302C of the liquor 300 in the third vessel 200C. The controller 434C may receive the signal $S_{430C}$ from a sensor 430C configured to detect a level of a surface 302C of the liquor 300 in the third vessel 200C. In an embodiment, a controller arrangement (414B, 434C) is configured to control a valve arrangement (432C, 412B) by using signals ($S_{430C}$, $S_{410B}$) indicative of content(s) of at least a compound of the liquor in the second vessel 200B and a level of a surface 302C of the liquor 300 in the third vessel 200C, wherein the valve arrangement (432C, 412B) is configured to limit the flow from the second vessel 200B to the third vessel 200C.

While FIGS. 7*a*, 7*b*, 7*c*, and 8 primarily illustrate oxidation of white liquor, FIG. 9 shows an embodiment for acidifying and oxidizing black liquor 300. The process comprises a pre-treatment stage (vessel 200P) producing liquor a flow $F_0$ of the liquor 300 to be oxidized, as indicated in the upper part of FIG. 9. The pre-treated liquor is oxidized thereafter in the first stage, in the vessel 200, as indicated in the lower part of FIG. 9. In the pre-treatment stage (vessel 200P), the bisulphide $HS^-$ is removed by acidifying the liquor 300. In the first stage (vessel 200) bisulphide $HS^-$ is removed by oxidation of the liquor 300.

Referring to lower part of FIG. 9, acidified black liquor 300 is conveyed to a first stage (i.e. a first vessel 200). The liquor is oxidized using the first injector arrangement 710. As indicated in FIG. 9, the reagent gas 310 comprises at least first feed gas 310', which comprises oxygen. The first feed gas 310' may comprise at least 50 vol % oxygen. The reagent gas 310 may further comprise gas obtained from a top part of the first vessel 200A. The reagent gas 310 may be a mixture of the first feed gas 310' and the recycled gas. An oxygen content of the reagent gas 310 may be at least 25 vol %.

Depending on the oxygen concentration of the reagent gas 310, the reactions taking place include:

$$2HS^- + 2O_2 \leftrightarrow S_2O_3^{2-} + H_2O$$ (i.e. thiosulphate is formed) and $$2HS^- + 4O_2 \leftrightarrow 2SO_4^{2-} + 2H_2O$$ (i.e. sulphate is formed).

It the vessel 200, the process conditions may be such that mainly sulphate is formed. Oxidation of hydrogen sulphide is exothermic.

In order to maintain the temperature of the black liquor reasonably low in the first vessel 200, a heat exchanger 280, i.e. a first heat exchanger 280, may be configured to cool the black liquor. The heat exchanger 280 may be arranged as part of the secondary circulation of the first stage, i.e. to cool the black liquor that is recycled from the vessel 200 back to the vessel 200. The heat exchanger 280 or another heat exchanger may be arranged in the vessel 200 in order to cool the black liquor. Heat exchange medium 282, such as water, is circulated through the heat exchanger 280. Heated medium 284, having been heated by the black liquor 300, exits the heat exchanger 280.

Referring to the upper part of FIG. 9, in order to acidify the black liquor before the oxidation, the method and system further comprises a pre-treatment stage. In the pre-treatment stage, the black liquor 300 is at least acidified in a pre-treatment vessel 200P. The black liquor 300 is at least acidified in a pre-treatment vessel 200P by using a pre-treatment injector arrangement 710P and a pre-treatment pump arrangement 720P. The liquor 300 is acidified by pumping the liquor 300 to the pre-treatment injector arrangement 710P using the pre-treatment pump arrangement 720P, thereby generating suction at a gas inlet of the pre-treatment injector arrangement 710P, and mixing pre-treatment gas 310P with the liquor 300, and letting out the pre-treated liquor 300 from the pre-treatment injector arrangement 710P to the pre-treatment vessel 200P.

Thus, the liquor 300 is reacted with the pre-treatment reagent gas 310P using the same principles as discussed above. The pre-treatment reagent gas 310 comprises at least an acid gas to acidify the black liquor. Preferably the acid gas used for acidification of black liquor comprises carbon dioxide $CO_2$. What has been said above about the acid gas content of the reagent gas 310 applies to the pre-treatment reagent gas 310P. The pre-treatment reagent gas 310P need not comprise oxygen. Preferably, the pre-treatment comprises letting out the liquor 300 from the pre-treatment vessel 200P via an outlet 210P and recycling the liquor back to the pre-treatment vessel 200P via the pre-treatment injector arrangement 710 using the pre-treatment pump arrangement 720.

When treating black liquor (weak black liquor, or partly concentrated black liquor, or concentrated black liquor) in the pre-treatment stage, the pre-treatment gas 310P comprises an acid gas, preferably carbon dioxide $CO_2$. The acid gas is used to acidify the black liquor, which has two effects. First, as indicated above, some of the bisulphide $HS^-$ converts into hydrogen sulphide $H_2S$. Moreover some of the lignin of the black liquor is precipitated. Moreover, in addition to acidifying, the black liquor may be oxidized already in the pre-treatment stage. In an embodiment, a mixture of a pre-treatment feed gas 310P' and gas obtained from a top part of the first vessel 200A is used as the pre-treatment gas 310P (see FIG. 9). Therefore, the oxygen which is not reacted in the first stage (vessel 200) can be used in the pre-treatment stage (vessel 200P).

In order to maintain the temperature of the black liquor reasonably low in the pre-treatment vessel 200P, a pre-treatment heat exchanger 280P may be configured to cool the black liquor. The pre-treatment heat exchanger 280P may be arranged as part of the secondary circulation of the pre-treatment stage, i.e. to cool the black liquor that is recycled from the pre-treatment vessel 200P back to the pre-treatment vessel 200P. The pre-treatment heat exchanger 280P or another heat exchanger may be arranged in the pre-treatment vessel 200P in order to cool the black liquor. Heat exchange medium 282P, such as water, is circulated through the pre-treatment heat exchanger 280P. Heated medium 284P, having been heated by the black liquor 300, exits the pre-treatment heat exchanger 280P.

The main purpose of oxidizing the pre-treated black liquor is to oxidize the $H_2S$ produced in the acidification (i.e. pre-treatment). However, $H_2S$ is a gaseous compound, and it may be oxidized, in the alternative, by burning. Thus, it is possible to remove the bisulphide (i.e. $HS^-$ ions) from the black liquor by only acidifying using an acid gas, as discussed above as the pre-treatment step. However, the oxidization stage may be omitted. In such a case, the gaseous $H_2S$ may be conveyed into a furnace for burning. The furnace may be e.g. the furnace of a chemical recovery boiler of a pulp mill. Such acidifying is discussed in more detail in connection with FIG. 10 and green liquor.

As indicated above, the embodiments of FIGS. 7*a*, 7*b*, 7*c*, 8, and 9 comprise oxidizing some liquor 300 of a pulp mill process. Therefore the reagent gas 310 comprises oxygen. In addition, in the embodiment of FIG. 9, the liquor 300 is pre-treated with at least an acid gas.

Figure 10:
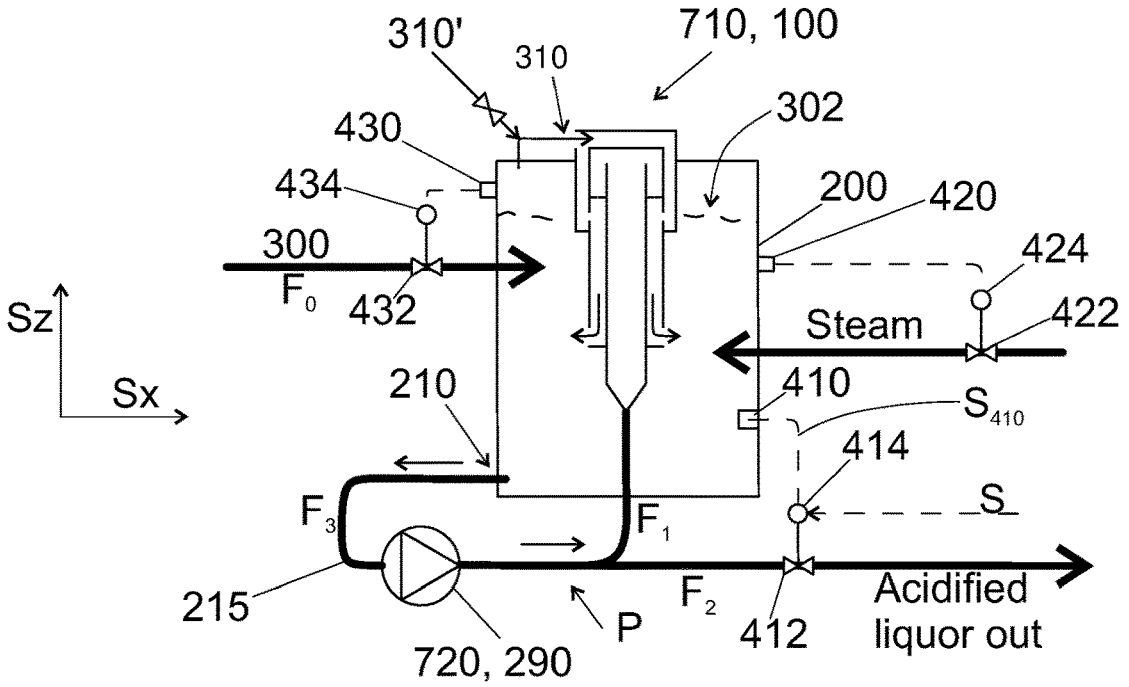
FIG. 10 shows a one-stage process and system for acidifying liquor and optionally recycling some of the reagent gas.

In contrast, FIG. 10 shows an embodiment for acidifying green liquor 300 or black liquor 300, as indicated above. For sake of clarity, the embodiment of FIG. 10 is discussed as the liquor 300 being green liquor. FIG. 11 shows the chemical principles of removing $HS^-$ ions from the liquor 300 by acidifying. As indicated in FIG. 11, when the pH of the liquor 300 is from about 7 to 13, the sulphur tends to form hydrogen sulphide ions $HS^-$ in the liquor 300. However, when the liquor is acidified, i.e. its pH is lowered, the chemical balance of the hydrogen and sulphur is more favourable for the gaseous hydrogen sulphide $H_2S$. Thus, by acidifying the liquor 300, a greater portion of the $HS^-$ ions react with the $H_3O^+$ ions to form gaseous hydrogen sulphide $H_2S$ and water $H_2O$, whereby some of the ions $HS^-$ are removed. As indicated above, in such an embodiment, the reagent gas 310 comprises some acid gas, such as carbon dioxide $CO_2$ and/or sulphur dioxide $SO_2$.

Correspondingly, as indicated in FIG. 10, hydrogen sulphide ions ($HS^-$) can be removed by feeding reagent gas 310 via the injector arrangement 710 to the liquid, as indicated above. The reagent gas 310 comprises an acid gas in order to acidify the liquor 300. Examples of suitable acid gases have been five above. The reagent gas 310 may be a mixture of feed gas 310' and gas recycled from the vessel 200, as indicated in FIG. 10. In the alternative, gas needs not to be recycled, whereby the reagent gas 310 may consist of the feed gas 310'. What has been said above about the content of the acid gas or acid gases of the reagent gas 310 applies also in this embodiment.

Even if not shown, a two-stage process or a three stage process, as indicated in FIGS. 7*b* and 7*c*, respectively, can be used for acidifying. It is possible that in both stages (vessels 200 and 200B) or in all vessels (200, 200B, and 200C) the liquor is only acidified. However, it is equally possible that the first stage (i.e. vessel 200) is used only for acidifying and a subsequent stage (e.g. vessel 200B or vessel 200C) is used for at least oxidation the acidified liquor. Regardless of the type of treatment, preferably also the second injector arrangement 710B and/or the second vessel 200B includes a collision element 117 configured to divide the bubbles as discussed in connection with FIGS. 4*a* and 4*b*. Regardless of the type of treatment, preferably also the third injector arrangement 710C and/or the third vessel 200C includes a collision element 117 configured to divide the bubbles as discussed in connection with FIGS. 4*a* and 4*b*.

Even if not shown in the figures, an injector arrangement can be used for pre-treatment or post-treatment of the liquor 300 using suitable gas. Such gas of the pre-treatment or post-treatment stage need not to be configured to configured to remove hydrogen sulphide ions $HS^-$ from the liquor 300.

The invention claimed is:

1. A method for removing hydrogen sulphide ions ($HS^-$) from a liquor of a pulp mill process, the method comprising:

pumping the liquor to an injector arrangement using a pump arrangement, the injector arrangement comprising at least one injector, the at least one injector comprising: a first chamber configured to receive the liquor from the pump arrangement, a jet nozzle for forming a jet of the liquor, and a gas inlet passage configured to convey reagent gas to be mixed with the jet, letting out the liquor from the injector arrangement to a vessel, whereby some of the hydrogen sulphide ions ($HS^-$) are removed from the liquor and at least partly treated liquor is formed, and conveying a part of the liquor from a first outlet of the vessel to a circulation of the liquor to a point upstream from the injector arrangement, wherein the pumping of the liquor through the jet nozzle generates the jet and suction at the gas inlet passage such that an absolute pressure of the reagent gas in the gas inlet passage is from 0.1 atm to 1.0 atm, whereby reagent gas is mixed with the liquor.

2. The method of claim 1, wherein the first outlet of the vessel is arranged at a lower part of the vessel.

3. The method of claim 1, wherein the first outlet of the vessel is arranged at a bottom of the vessel.

4. The method of claim 2, wherein:

a first mass flow of the liquor is conveyed using the pump arrangement via the injector arrangement to the vessel, a second mass flow of the liquor is conveyed from the vessel for use and/or for further treatment by gas, and a third mass flow of the liquor is recycled from the first outlet of the vessel to the circulation of the liquor, wherein a ratio of the second mass flow to the third mass flow is from 10% to 90%.

5. The method of claim 1, further comprising:

measuring a content of a compound or compounds of the liquor from the vessel or from another vessel, and controlling a flow of the liquor from the vessel or the other vessel, respectively, by using the measured content of the compound or compounds of the liquor.

6. The method of claim 5, wherein either:

the compound or compounds is/are such a compound or compounds of the liquor of which content is affected by reaction of the liquor with the reagent gas, or the compound or at least one of the compounds is either sodium sulphide ($Na_2S$) or sodium thiosulphate ($Na_2S_2O_3$).

7. The method of claim 1, further comprising:

conveying at least partly treated liquor from the vessel into a second vessel, pumping the at least partly treated liquor to a second injector arrangement using a second pump arrangement, thereby: generating suction at a gas inlet of the second injector arrangement, and mixing second gas with the at least partly treated liquor, letting out the at least partly treated liquor from the second injector arrangement to the second vessel, whereby the at least partly liquor is further reacted with the second gas, and an oxygen content of the second gas is greater than an oxygen content of the reagent gas.

8. The method of claim 1, comprising a pre-treatment stage upstream from the vessel, wherein:

the pre-treatment stage comprises:

pumping the liquor to a pre-treatment injector arrangement using a pre-treatment pump arrangement, thereby: generating suction at a gas inlet of the pre-treatment injector arrangement, and mixing pre-treatment gas with the liquor, and letting out the liquor from the pre-treatment injector arrangement to a pre-treatment vessel, whereby the liquor is reacted with the pre-treatment gas, and the method further comprises conveying the pre-treated liquor from the pre-treatment vessel to the vessel.

9. The method of claim 1, wherein at least one of:

[A] the injector comprises a collision element, wherein the jet nozzle is arranged relative to the collision element in such a way that the jet formed by the jet nozzle is directed towards the collision element;

[B] the liquor is pumped to the vessel via the injector arrangement in such a way that the mixing of the reagent gas with the liquor forms bubbles of which an average diameter is at most 5 mm; or

[C] the liquor is pumped to the vessel via the injector arrangement in such a way that a velocity of the liquor in the jet is at least 5 m/s.

10. The method of claim 1, wherein:

the liquor comprises sodium sulphide ($Na_2S$), the reagent gas comprises oxygen ($O_2$), and the method further comprises oxidizing sodium sulphide ($Na_2S$) to at least sodium thiosulphate ($Na_2S_2O_3$) by chemical reaction of the liquor with the reagent gas, thereby removing hydrogen sulphide ions ($HS^-$) from the liquor.

11. The method of claim 1, wherein:

the liquor comprises sodium sulphide ($Na_2S$), the reagent gas comprises oxygen ($O_2$), and the method further comprises:

receiving liquor having a sodium sulphide ($Na_2S$) content of from 25 g/l to 60 g/l, and oxidizing the received liquor in such a way that the sodium sulphide ($Na_2S$) content of the at least partly oxidized liquor in the vessel is less than 3 g/l.

12. The method of claim 11, wherein the sodium sulphide ($Na_2S$) content is at most 1.5 g/l.

13. The method of claim 1, wherein:

the liquor comprises sodium sulphide ($Na_2S$), the reagent gas comprises acid gas, the method further comprises acidifying the liquor to remove hydrogen sulphide ions ($HS^-$) from the liquor, and the reagent gas comprises an acid gas selected from a group consisting of carbon dioxide ($CO_2$), sulphur dioxide ($SO_2$), sulphur trioxide ($SO_3$), a nitrogen oxide (NOx), hydrogen fluoride (HF), hydrogen chloride (HCl), hydrogen bromide (HBr), hydrogen iodide (HI), and formic acid (HCOOH).

14. The method of claim 13, wherein the reagent gas is carbon dioxide ($CO_2$) or sulphur dioxide ($SO_2$).

15. The method of claim 1, further comprising heating the liquor or the at least partly treated liquor by injecting steam into the vessel.

16. The method of claim 1, wherein the temperature of the liquor in the vessel is from 80° C. to 98° C.

17. The method of claim 1, further comprising one of [A], [B], [C], or [D], each defined as:

[A]:

forming the liquor in a causticizer, whereby the liquor is white liquor of a Kraft process, using such a reagent gas that comprises oxygen ($O_2$), and oxidizing white liquor; and/or using the oxidized white liquor in delignification plant or bleaching process for pulp;

[B]:

forming the liquor in a digester, and optionally concentrating the liquor, whereby the liquor is black liquor of a Kraft process, using such a reagent gas or gases that comprise oxygen ($O_2$) and an acid gas, and acidifying and oxidizing the black liquor;

[C]:

forming the liquor in a chemical recovery boiler, whereby the liquor is green liquor of a Kraft process, using such a reagent gas or gases that comprise acid gas, and acidifying the green liquor;

[D]:

forming the liquor in a digester, and optionally concentrating the liquor, whereby the liquor is black liquor of a Kraft process, using such a reagent gas or gases that comprise acid gas, and acidifying the black liquor.

18. A method for removing hydrogen sulphide ions ($HS^-$) from a liquor of a pulp mill process, the method comprising:

pumping the liquor to an injector arrangement using a pump arrangement, the injector arrangement comprising at least one injector, the at least one injector comprising: a first chamber configured to receive the liquor from the pump arrangement, a jet nozzle for forming a jet of the liquor, and a gas inlet passage configured to convey reagent gas to be mixed with the jet, letting out the liquor from the injector arrangement to a vessel, whereby some of the hydrogen sulphide ions ($HS^-$) are removed from the liquor and at least partly treated liquor is formed, conveying a part of the liquor from a first outlet of the vessel to a circulation of the liquor to a point upstream from the injector arrangement, wherein the pumping of the liquor through the jet nozzle generates the jet and suction at the gas inlet passage, whereby reagent gas is mixed with the liquor, conveying at least partly treated liquor from the vessel into a second vessel, pumping the at least partly treated liquor to a second injector arrangement using a second pump arrangement, thereby: generating suction at a gas inlet of the second injector arrangement, and mixing second gas with the at least partly treated liquor, letting out the at least partly treated liquor from the second injector arrangement to the second vessel, whereby the at least partly liquor is further reacted with the second gas, and wherein an oxygen content of the second gas is greater than an oxygen content of the reagent gas.

19. The method of claim 18, wherein:

the liquor comprises sodium sulphide ($Na_2S$), the reagent gas comprises acid gas, the method further comprises acidifying the liquor to remove hydrogen sulphide ions ($HS^-$) from the liquor, and the reagent gas comprises an acid gas selected from a group consisting of carbon dioxide ($CO_2$), sulphur dioxide ($SO_2$), sulphur trioxide ($SO_3$), a nitrogen oxide (NOx), hydrogen fluoride (HF), hydrogen chloride (HCl), hydrogen bromide (HBr), hydrogen iodide (HI), and formic acid (HCOOH).

20. The method of claim 19, wherein the reagent gas is carbon dioxide ($CO_2$) or sulphur dioxide ($SO_2$).

* * * * *